US009695596B2

(12) United States Patent
McIntosh et al.

(10) Patent No.: US 9,695,596 B2
(45) Date of Patent: Jul. 4, 2017

(54) NATURAL ROCK PANEL, NATURAL ROCK VENEER PANEL AND PANEL SUPPORT APPARATUS

(75) Inventors: Robert Gordon McIntosh, Abbotsford (CA); Brian Philip Nemez, Port Moody (CA)

(73) Assignee: Pacific Prebenched Ltd., Aldergrove (CA)

( * ) Notice: Subject to any disclaimer, the term of this patent is extended or adjusted under 35 U.S.C. 154(b) by 0 days.

(21) Appl. No.: 14/115,082

(22) PCT Filed: Apr. 18, 2012

(86) PCT No.: PCT/CA2012/000355

§ 371 (c)(1),
(2), (4) Date: Oct. 31, 2013

(87) PCT Pub. No.: WO2012/149630

PCT Pub. Date: Nov. 8, 2012

(65) Prior Publication Data

US 2014/0083033 A1 Mar. 27, 2014

Related U.S. Application Data

(60) Provisional application No. 61/481,681, filed on May 2, 2011.

(51) Int. Cl.
*E04B 2/72* (2006.01)
*E04C 2/28* (2006.01)
(Continued)

(52) U.S. Cl.
CPC ..... *E04F 13/007* (2013.01); *E04B 2/721* (2013.01); *E04C 2/288* (2013.01); *E04C 2/38* (2013.01);
(Continued)

(58) Field of Classification Search
CPC ..... E04B 2002/0269; E04B 2002/0271; E04B 2/721; E04B 2/90; E04C 2002/008;
(Continued)

(56) References Cited

U.S. PATENT DOCUMENTS 338,490 A 3/1886 Cowan
1,572,919 A * 2/1926 Geese ..... 52/314
(Continued)

FOREIGN PATENT DOCUMENTS

CA 1329013 C 5/1994
CA 2659649 A1 9/2009
EP 1726731 A2 11/2006

OTHER PUBLICATIONS

"Boise Cascade", Nov. 2013, http://tinyhousecommunity.com/docs/weights-building-materials.pdf.*
(Continued)

*Primary Examiner* — Ryan Kwiecinski
(74) *Attorney, Agent, or Firm* — Knobbe, Martens, Olson & Bear, LLP

(57) ABSTRACT

An architectural finish element operable to be placed adjacent similar architectural finish elements to form a finished surface on an architectural structure includes a body formed of a rock-based composite material comprising a low density solid particle additive, a plurality of unitary real stone veneer elements bonded to the body in courses extending in a first direction and in a random non-repetitive pattern, the real stone veneer elements having respective face surfaces generally lying in a plane to form an overall face surface of the architectural finish element. The low density solid particle additive is provided in an amount suitable to cause the architectural finish element to have a density of between about 10 to 15 pounds per square foot. The architectural finishing element may be mounted by mounting a portion of
(Continued)

a body of at least one dual architectural finish element support to a surface of an architectural structure.

45 Claims, 15 Drawing Sheets

(51) Int. Cl.

| | |
|---|---|
| ***E04F 13/14*** | (2006.01) |
| ***E04F 13/08*** | (2006.01) |
| ***E04F 13/00*** | (2006.01) |
| ***E04C 2/288*** | (2006.01) |
| ***E04C 2/38*** | (2006.01) |
| ***E04F 13/09*** | (2006.01) |
| *E04C 2/00* | (2006.01) |
| *E04B 2/02* | (2006.01) |

(52) U.S. Cl.
CPC ..... *E04F 13/0801* (2013.01); *E04F 13/0846* (2013.01); *E04F 13/0878* (2013.01); *E04F 13/0885* (2013.01); *E04F 13/0892* (2013.01); *E04F 13/0894* (2013.01); *E04F 13/09* (2013.01); *E04F 13/14* (2013.01); *E04F 13/144* (2013.01); *E04B 2002/0269* (2013.01); *E04B 2002/0271* (2013.01); *E04C 2002/008* (2013.01); *E04F 2201/026* (2013.01); *Y10T 428/192* (2015.01)

(58) Field of Classification Search
CPC ..... E04C 2/041; E04C 2/288; E04F 13/0805; E04F 13/083; E04F 13/0835; E04F 13/0851; E04F 13/144; E04F 13/0894
USPC ..... 52/235, 311.2, 314, 315, 384–386, 388, 52/389
See application file for complete search history.

(56) References Cited

U.S. PATENT DOCUMENTS 1,751,272 A 3/1930 Forman
1,896,325 A * 2/1933 Noonan ..... E04F 13/0803 52/385
2,198,011 A 4/1940 Muirhead
D213,618 S 3/1969 Pickering
3,685,240 A * 8/1972 Oscari ..... 52/385
3,775,916 A * 12/1973 Bair ..... E04B 2/60 52/125.4
3,905,170 A * 9/1975 Huettemann ..... 52/314
4,068,482 A 1/1978 Hilfiker
D249,976 S 10/1978 Gronert
D250,898 S 1/1979 Schuring
D252,951 S 9/1979 Schuring
4,238,915 A * 12/1980 Yoshida ..... E04F 13/14 52/386
4,514,113 A 4/1985 Neumann
D283,551 S 4/1986 Repasky
4,592,678 A 6/1986 McNinch, Jr. et al.
D299,068 S 12/1988 McSorley et al.
D299,069 S 12/1988 Risi et al.
D299,170 S 12/1988 Meheen
D300,250 S 3/1989 Meheen
4,815,897 A 3/1989 Risi et al.
D300,863 S 4/1989 McNeely
D310,267 S 8/1990 Zeidman
D313,280 S 12/1990 Rodenburgh et al.
D319,885 S 9/1991 Blomquist et al.
5,120,164 A 6/1992 Iacocca et al.
D331,469 S 12/1992 McMarlin
D336,140 S 6/1993 Lavery
D336,341 S 6/1993 Van Steenlandt
D340,293 S 10/1993 Risi et al.
D340,996 S 11/1993 Woolbright
D346,667 S 5/1994 Blomquist et al.
D347,285 S 5/1994 Woolbright
5,337,527 A 8/1994 Wagenaar
D351,239 S 10/1994 Klenert
D352,560 S 11/1994 Lin
D352,789 S 11/1994 Adam
D353,680 S 12/1994 Jansson
5,372,676 A 12/1994 Lowe
D357,748 S 4/1995 Jansson
D360,475 S 7/1995 Woolbright
D362,077 S 9/1995 Woolbright
D362,311 S 9/1995 Cataldo
D365,643 S 12/1995 Wilhelm
D370,272 S 5/1996 Risi et al.
D372,106 S 7/1996 Woolbright
5,564,245 A 10/1996 Rademacher
5,601,384 A 2/1997 Dawson
5,607,262 A 3/1997 Martin
5,622,456 A 4/1997 Risi et al.
D379,668 S 6/1997 Karanikas
D379,669 S 6/1997 Karanikas
D379,670 S 6/1997 Karanikas
D380,560 S 7/1997 Forsberg
D381,086 S 7/1997 Forsberg
D381,437 S 7/1997 Browning
D382,349 S 8/1997 Hinton
D386,265 S 11/1997 Ellington
D391,376 S 2/1998 Blomquist et al.
D397,230 S 8/1998 Forsberg
5,787,666 A 8/1998 Sherry
5,800,095 A 9/1998 Egan
D404,146 S 1/1999 Perkins
5,913,790 A 6/1999 Dawson
D416,627 S 11/1999 McAllister
D424,714 S 5/2000 Hale
D428,499 S 7/2000 Bazzocchi
D429,004 S 8/2000 Blomquist et al.
D429,006 S 8/2000 Price et al.
D430,308 S 8/2000 Dawson
D433,158 S 10/2000 Hammer
D434,508 S 11/2000 Price et al.
D435,302 S 12/2000 Blomquist et al.
D435,917 S 1/2001 Hammer
D437,422 S 2/2001 Bolles et al.
D438,640 S 3/2001 Bolles et al.
D445,512 S 7/2001 Sievert
D447,573 S 9/2001 Blomquist et al.
D448,492 S 9/2001 Bazzocchi
6,305,135 B1 * 10/2001 Inaba ..... 52/309.12
6,318,934 B1 11/2001 Borgersen et al.
D452,332 S 12/2001 Blomquist et al.
D458,387 S 6/2002 Blomquist et al.
D458,693 S 6/2002 Sievert
D464,145 S 10/2002 Scherer et al.
D464,149 S 10/2002 Risi et al.
D464,440 S 10/2002 Risi et al.
D465,855 S 11/2002 Risi et al.
D466,228 S 11/2002 Hammer
D466,229 S 11/2002 Risi et al.
D466,619 S 12/2002 Britton
D467,009 S 12/2002 Agee
D468,449 S 1/2003 Britton
6,536,994 B2 3/2003 Race
6,615,561 B2 9/2003 MacDonald et al.
D482,133 S 11/2003 Scherer et al.
6,651,401 B2 11/2003 Price et al.
D484,620 S 12/2003 He
D485,371 S 1/2004 Burgess et al.
6,679,656 B1 1/2004 Manthei
D500,864 S 1/2005 Klettenberg et al.
6,854,220 B2 2/2005 Dueck et al.
D506,837 S 6/2005 Scherer et al.
D509,909 S 9/2005 Sorheim
D509,910 S 9/2005 Risi et al.
D510,144 S 9/2005 Risi et al.
D511,579 S 11/2005 Risi et al.
D511,846 S 11/2005 Evans
D512,162 S 11/2005 Risi
6,978,580 B1 12/2005 Clark et al.

(56) References Cited

U.S. PATENT DOCUMENTS

| | | | | |
|---|---|---|---|---|
| D513,805 | S | 1/2006 | Scherer et al. | |
| D516,228 | S | 2/2006 | Dunbar | |
| D516,734 | S | 3/2006 | Keys et al. | |
| D517,221 | S | 3/2006 | Keys et al. | |
| 7,096,635 | B2 | 8/2006 | Price et al. | |
| D529,195 | S | 9/2006 | Mugge | |
| D530,831 | S | 10/2006 | Mugge et al. | |
| 7,125,203 | B1 | 10/2006 | Evans | |
| D537,533 | S | 2/2007 | Strand | |
| D539,438 | S | 3/2007 | Price | |
| D541,951 | S | 5/2007 | Mugge et al. | |
| D546,972 | S | 7/2007 | Price | |
| D547,881 | S | 7/2007 | Price et al. | |
| 7,244,079 | B1 | 7/2007 | Blomquist et al. | |
| D548,365 | S | 8/2007 | Price | |
| D548,366 | S | 8/2007 | Price | |
| D548,367 | S | 8/2007 | Price | |
| D579,122 | S | 10/2008 | McIntosh | |
| D587,381 | S | 2/2009 | McIntosh | |
| D600,359 | S | 9/2009 | King | |
| 7,644,548 | B2 | 1/2010 | Guevara et al. | |
| 7,647,738 | B2 | 1/2010 | Nasvik | |
| D610,899 | S * | 3/2010 | Hikai | D8/382 |
| D626,407 | S * | 11/2010 | Tedesco | D8/380 |
| 7,959,380 | B2 | 6/2011 | McIntosh | |
| 7,997,039 | B2 | 8/2011 | Wolf et al. | |
| D656,393 | S * | 3/2012 | Honda | D8/349 |
| 2001/0045075 | A1* | 11/2001 | Watanabe | E04F 13/0826 52/712 |
| 2001/0047741 | A1* | 12/2001 | Gleeson | C04B 28/04 106/709 |
| 2003/0012608 | A1 | 1/2003 | Race | |
| 2005/0069389 | A1 | 3/2005 | Shaw | |
| 2005/0210811 | A1 | 9/2005 | Nasvik | |
| 2005/0246983 | A1* | 11/2005 | Loyd | E04F 13/0803 52/235 |
| 2006/0283128 | A1 | 12/2006 | Price et al. | |
| 2007/0151190 | A1* | 7/2007 | Huff et al. | 52/592.5 |
| 2008/0155921 | A1 | 7/2008 | Wolf | |
| 2009/0094917 | A1 | 4/2009 | McIntosh | |
| 2009/0126301 | A1* | 5/2009 | Brown et al. | 52/314 |
| 2009/0193741 | A1* | 8/2009 | Cappelle | 52/309.1 |
| 2010/0088989 | A1* | 4/2010 | Nasvik | B32B 13/04 52/309.4 |
| 2010/0192495 | A1 | 8/2010 | Huff et al. | |
| 2010/0325993 | A1 | 12/2010 | Bolin | |
| 2012/0241574 | A1* | 9/2012 | Uota | E04F 13/0846 248/231.81 |
| 2014/0196399 | A1* | 7/2014 | Egri, II | E04F 13/0805 52/704 |

OTHER PUBLICATIONS

International Search Report and Written Opinion dated Aug. 9, 2012 for International Application No. PCT/CA2012/000355.

Advantage Trim and Lumber, Hardwood Siding, website, retrieved Feb. 14, 2002, 3 pages.

Allan Block, Allan Block Fence Systems, 2 pages, circa 2003, Minnesota, USA.

Allan Block, Allan Block Product Collections, website <www.allanblock.comRetainingWallsProductsCollections.aspxta=1>, retrieved Sep. 5, 2007.

Allan Block, Landscape Lifestyles, 11 pages, circa 2002, Minnesota, USA.

Allan Block, Landscape Walls—A Complete Guide to Plan, Design and Build Landscape Walls, 44 pages, circa 2006, Minnesota, USA, disclosed during prosecution of US D579,122 S, which issued on Oct. 21, 2008.

Arriscraft, Parapet to Wall With Stone or Precast Cap, SS12SU AC122, 1 page, drawn Nov. 30, 2009, 1 page.

Barkman Concrete, CornerStone, website <www.barkmanconcrete.com/products/retaining_walls/cornerstone.html>, retrieved Sep. 5, 2007, 1 page.

Barkman Concrete, DuraHold, website <www.barkmanconcrete.com/productsretaining_wallsdurahold.html>, retrieved Sep. 5, 2007, 1 page.

Barkman Concrete, Quarry Stone Retaining Walls Installation Guide, May 2007, 6 pages.

Barkman Concrete, Pisa2 & RomanPisa Retaining Walls Installation Guide, May 2007, 8 pages.

Barkman Concrete, StackStone & RomanStack Retaining Walls Installation Guide, May 2007, 8 pages.

Biesanz Stone Company, Prefabricated Natural Stone Panels, website <products.construction.com/Manufacturer/Biesanz-Stone-Company-NST152124>, 1 page retrieved Feb. 17, 2012.

Bradstone, Naturally Preferred, 2005, 8 pages, Ontario, Canada.

Bradstone, The Natural Stone Alternative—Mountain Block Retaining Wall, website <bradstone.ca>, retrieved Aug. 14, 2007, 2 pages.

Buildex, Buildex Vancouver: Official Showguide, Feb. 8, 2012 and Feb. 9, 2012, Vancouver, Canada, 52 pages.

Canon Fasteners, Cannon Fasteners: Fixing Devices, website <www.indiamart.com/canonfasteners/fixing-devices.html>, retrieved Feb. 14, 2012, 1 page.

Carter, Build Stackable or Segmental Retaining Walls, website <www.askthebuilder.com/128_Stackable_amp_Segmental_Retaining_Walls.shtml>, retrieved Sep. 6, 2007, 3 pages.

Cellular Concrete LLC, Geofoam: Low-Density Cellular Concrete, circa 1999 and 2000, Allentown, USA, 6 pages.

Cellular Concrete Solutions, Technical Bulletin, received from client Sep. 30, 2014, 2 pages.

Cemex Mortars, Experts in Mortar: Educational Guide to Aggregates, 19 pages.

Ceraclad, Ceraclad Rain Screen Exterior Siding System, 2 pages, Redmond, USA.

Ceraclad, Rain Screen Exterior Siding System: Accessories, website <www.kmew.co.jp/cerclad>, retrieved Feb. 14, 2012, 3 pages.

Cloud Stone, Technical Data, website <www.cloudstonewalls.ca/index.php/technical-data>, retrieved Sep. 17, 2014, p. 1 of 2.

Coote, Handler New 3MPH—Coote Concrete Production Machinery, website <web.archive.org/web/20010412144152/cooteus.com/handler>, retrieved Jun. 12, 2009, 1 page.

Cyngus Panel, Construction Dimensions, website <http://www.kepcoplus.com/files/pagetext/images/1711165956887jpg>, retrieved Feb. 16, 2012, 4 pages.

Designpro, Concrete Block Catalogue, catalogue, 32 pages, Duluth, USA. Disclosed during prosecution of US D587,381S which issued on Feb. 24, 2009.

Designpro, Landscape Block Form, guide, 4 pages, Duluth, USA. Disclosed during prosecution of US D587,381S which issued on Feb. 24, 2009.

Durisol, Durisol Retaining Wall Systems, website <http://www.durisol.com/p1retaining.htm>, retrieved Sep. 5, 2007, 2 pages.

ES Report, Evaluation Subject: "Nichiha Brick and Stone Panels, Sierra Premium Panels, Homestead Vertical Panels, Made with Nichiha "M", "EX," and "W" Series Fiber Cement Product Lines", report, reissued Dec. 1, 2007, 11 pages.

Fusion Stone, Dry-Stack: Typical Cross Section of Veneer Mounting System DS-11, drawn Sep. 24, 2009, 1 page.

Gerns, Design Issues for Thin-Stone Cladding Systems, RCI Symposium of Building Envelope Technology, article, presented Nov. 14-15, 2002, 6 pages.

Gerpass, Stone Fixings, hand-written dated Feb. 14, 2012, 3 pages.

Gridworx, Mechanical Stone Hanging System, circa 2006, 9 pages, Dallas, USA.

Inter-Block Retaining Systems, specifications, website <www.inter-block.com/specifications.html>, retrieved Sep. 5, 2007, San Marcos, USA.

Inter-Block Retaining Systems, Concrete Casting Blocks & Shapes, website <www.inter-block.com/block-styles.html>, retrieved Sep. 5, 2007, San Marcos, USA.

Inter-Block Retaining Systems, Retaining Walls, website <www.inter-block.com/retaining.html>, retrieved Sep. 5, 2007, San Marcos, USA.

Intertek, Subject: Air, Water, Structural Testing of 1x Stone Clad Wall Assembly, letter report, Nov. 27, 2013, 1 page.

(56) References Cited

OTHER PUBLICATIONS

IPE Clip Fastener Co., Deckwise Siding Fastener and Sliding Profile, figure, hand-dated Feb. 14, 2012, 2 pages.
Keybrick Walling System, People & Products, MC Magazine, Jan./Feb. 2005, p. 72.
Keystone Retaining Wall Systems, Caprezzo Stone, circa 2006, 2 pages, Minneapolis, USA.
Keystone Retaining Wall Systems, Country Manor, circa 2004, 2 pages, Minneapolis, USA.
Keystone Retaining Wall Systems, Palazzo Stone, circa 2006, 2 pages, Minneapolis, USA.
Keystone Retaining Wall Systems, Potenzo Stone, circa 2006, 2 pages, Minneapolis, USA.
Keystone Retaining Wall Systems, Stonegate Country Manor, circa 2006, 2 pages Minneapolis, USA.
Keystone Retaining Wall Systems, Verazzo Stone, circa 2006, 2 pages, Minneapolis, USA.
Noida India, Stone Cladding Clip 2 from Kunwar Brothers & Co, website <noida.indiabizclub.com/catalog/649160>, retrieved Feb. 14, 2012, 1 page.
Kunwar Brothers & Co, Stone Cladding Clip, website <www.indiamart.com/kunwarbros/buliders-hardware.html>, retrieved Feb. 14, 2012, 1 page.
LondonBoulder, LondonBoulder, 4 pages. Disclosed during prosecution of US D587,381S which issued on Feb. 24, 2009.
Macon Concrete Products, Other Anchoring Methods, website <sites.securemc.com/folder24360/index.cfm?id=139991&fuseaction . . . >, retrieved Sep. 6, 2007, San Antonio, USA.
Moderra, 8" Block Unit-No Score Drawing No. 180, May 13, 2004, 1 page, Rochester, USA.
Navastone, Garden Projects: Garden Walls, circa 2003, 2 pages, printed in Canada.
Navastone, Grande product webpage, website <www.navastone.com/productDetails.php?prod_id=49>, retrieved Sep. 5, 2007, 2 pages.
Navastone, Hadrians product webpage, website <www.navastone.com/productDetails.php?prod_id=55>, retrieved Sep. 5, 2007, 2 pages.
Navastone, TriWedge product webpage, website <www.navastone.com/productDetails.php?prod_id=61>, retrieved Sep. 5, 2007, 2 pages.
Navastone, WallCap product webpage, website <www.navastone.com/productDetails.php?prod_id=50>, retrieved Sep. 5, 2007, 2 pages.
Navastone, WallstonePLUS product webpage, website <www.navastone.com/productDetails.php?prod_id=51>, retrieved Sep. 5, 2007, 2 pages.
Navastone, WedgestonePLUS product webpage, website <www.navastone.com/productDetails.php?prod_id=53>, retrieved Sep. 5, 2007, 2 pages.
Navastone, WedgestoneXL product webpage, website <www.navastone.com/productDetails.php?prod_id=54>, retrieved Sep. 5, 2007, 2 pages.
NCMA, Segmental Retaining Walls, website <http://www.ncma.org/Use/srw.html>, retrieved Sep. 6, 2007, 3 pages.
NRC Canada, CCMC Evaluation Report: "Nichiha EX Series Wall System", evaluation report, issued Sep. 6, 2002, re-evaluation due Sep. 6, 2005, 7 pages.
Realstone, Generix System, hand-dated Feb. 14, 2012, 2 pages, Derbyshire, UK.
Recon Retaining Wall Systems, Retaining Wall Systems Information Sheet, Minneapolis, USA. Disclosed during prosecution of US D587,381S which issued on Feb. 24, 2009.
Recon Retaining Wall Systems, Retaining Wall Systems Postcard, Minneapolis, USA. Disclosed during prosecution of US D587,381S which issued on Feb. 24, 2009.
Redi-Rock International, Beautiful, Massive & Rock Solid Retaining Walls, 4 pages, Charievoix, USA. Disclosed during prosecution of US D587,381S which issued on Feb. 24, 2009.
Redi-Rock International, Dealer Information, 11 pages, Charievoix, USA. Disclosed during prosecution of US D587,381S which issued on Feb. 24, 2009.
Redi-Rock International, Free Standing Walls & Accessories, 2 pages. Disclosed during prosecution of US D587,381S which issued on Feb. 24, 2009.
Redi-Rock International, New Niche Market Opportunity, information sheet, 1 page, Charlevoix, USA. Disclosed during prosecution of US D587,381S which issued on Feb. 24, 2009.
Redi-Rock International, News Jan. 2003, Jan. 2003, 2 pages.
Redi-Rock International, The Essence of Natural Rock, product catalogue, design revised Jun. 2005, retrieved from website <www.graymont.comtechnicalRediRock_Product_Catalog.pdf>, 16 pages, Charlevoix, USA.
Richway, CreteFoamer: Cellular Concrete Solves Problems, 2008, 2 pages, Janesville, USA.
Risistone, DuraHold, circa 2006, 2 pages.
Risistone, DuraHold2, circa 2006, 2 pages.
Risistone, Pisa2, circa 2006, 2 pages.
Risistone, PisaStone, circa 2006, 2 pages.
Risistone, RomanPisa, circa 2006, 2 pages.
Risistone, RomanStack, circa 2006, 2 pages.
Risistone, SienaStone, circa 2006, 2 pages.
Risistone, SonomaStone, circa 2006, 2 pages.
Risistone, StackStone, circa 2006, 2 pages.
Rockwood Retaining Walls, Endless Possibilities, catalogue, 2004, 76 pages, Rochester, USA.
Rockwood Retaining Walls, Installation Manual, 2004, 32 pages, Rochester, USA.
Rockwood Retaining Walls, Monument HD, 2006, 2 pages, Rochester, USA.
Rockwood Retaining Walls, the Classic 6 Wall, 2004, 2 pages, Rochester, USA.
Rockwood Retaining Walls, The Classic 8 Wall, 2004, 2 pages, Rochester, USA.
Rockwood Retaining Walls, The Classic Colonial Wall, 2006, 3 pages, Rochester, USA.
Rockwood Retaining Walls, The Legend Wall, 2004, 2 pages, Rochester, USA.
Rockwood Retaining Walls, The Vintage Wall, 2007, 2 pages, Rochester, USA.
Rocky Mountain Stoneworks, Rocking Mountain Stoneworks, 8 pages, Aldergrove, Canada, disclosed during prosecution of US D579,122 S, which issued on Oct. 21, 2008.
Rocky Wall Retaining Walls, Rocky Walls Retaining Walls, Sep. 2007, 2 pages, Aldergrove, Canada.
Sims Stone, Column Stone Decorative Retaining Walls, website <www.simsstone.com/retaining_walls_column.html>, retrieved Sep. 5, 2007, 1 page.
Sims Stone, Creta Stone Retaining Wall, website <www.simsstone.com/retaining_walls_creta.html>, retrieved Sep. 5, 2007, 1 page.
Sims Stone, FatFace™ Retaining Wall, website <www.simsstone.com/retaining_walls_fatface.html>, retrieved Sep. 5, 2007, 1 page.
Sims Stone, GravityStone™ Retaining Walls, website <www.simsstone.com/retaining_walls_gravitystone.html>, retrieved Sep. 5, 2007, 1 page.
Sims Stone, Jumbo NurseryStone™ Retaining Wall, website <www.simsstone.com/retaining_walls_jumbo.html>, retrieved Sep. 5, 2007, 2 pages.
Sims Stone, MaytRx™ System Retaining Walls, website <www.simsstone.com/retaining_walls_maytrx.html>, retrieved Sep. 5, 2007, 2 pages.
Sims Stone, Pyzique Retaining Wall Blocks, website <www.simsstone.com/retaining_walls_pyzique.html>, retrieved Sep. 5, 2007, 2 pages.
Sims Stone, Quarry Stone Retaining Wall, website <www.simsstone.com/retaining_walls_quarry.html>, retrieved Sep. 5, 2007, 1 page.
Sims Stone, Retaining Wall Selection Guide, website <www.simsstone.com/retaining_walls_selection.html>, retrieved Sep. 5, 2007, 2 pages.

(56) References Cited

OTHER PUBLICATIONS

Sims Stone, Stonewall™ Retaining Walls, website <www.sims-stone.com/retaining_walls_stonewall.html>, retrieved Sep. 5, 2007, 2 pages.
SRW, Retaining Wall & Paver Adhesive Product, 2 pages, Princeton, USA. Disclosed during prosecution of U.S. Pat. No. 7,959,380 B2 which issued on Jun. 14, 2011.
SRW, SRW Universal Geogrid Installation Guide, 2 pages, Princeton, USA. Disclosed during prosecution of U.S. Pat. No. 7,959,380 B2 which issued on Jun. 14, 2011.
Stone Caster Studio, Quick-Fit Stone Veneer Panel, website <www.stonecasterstudio.com/stone-veneer-fanels.html> retrieved using Wayback Machine <archive.org/web/>, website as appeared on Mar. 16, 2011.
Stone Strong Systems, Big Profits. Big Possibilities. Little Time to Waste, 2 pages, Lincoln, USA. Disclosed during prosecution of US D587,381S which issued on Feb. 24, 2009.
Stone Strong Systems, Block Types, website <www.stonestrong.comblock_06.php>, retrieved on Feb. 9, 2004, 1 page.
Stone Strong Systems, Form Usage, pp. 3-4. Disclosed during prosecution of US D587,381S which issued on Feb. 24, 2009.
Stone Strong Systems, Stone Strong Engineer: Stone Strong Consumer/Specifier Benefits, information sheet, 1 page. Disclosed during prosecution of US D587,381S which issued on Feb. 24, 2009.
Stone Strong Systems, Walls that Stand Up!, 4 pages, Lincoln, USA. Disclosed during prosecution of US D587,381S which issued on Feb. 24, 2009.
Sure Touch, Installation Guide: Masonry System Suretouch—Stone, guide, revised Jan. 4, 2010, 20 pages, Montreal, Canada.
Techo-Block, Monumental Blok, Walls & Steps, pp. 44-49, disclosed during prosecution of US D579,122 S, which issued on Oct. 21, 2008.
Techo-Block, Creta, Walls & Steps, p. 53. Disclosed during prosecution of US D587,381S which issued on Feb. 24, 2009.
Techo-Block, Econo & Antique Garden Wall, Walls & Steps, p. 57. Disclosed during prosecution of US D587,381S which issued on Feb. 24, 2009.
Techo-Block, Escala Nouveau, Walls & Steps, p. 54. Disclosed during prosecution of US D587,381S which issued on Feb. 24, 2009.
Techo-Block, Mini-Blok, Walls & Steps, p. 54. Disclosed during prosecution of US D587,381S which issued on Feb. 24, 2009.
Techo-Block, Mini-Crea 3" & 6" Plus, Walls & Steps, p. 52. Disclosed during prosecution of US D587,381S which issued on Feb. 24, 2009.
Techo-Block, Quarry Stone, Walls & Steps, p. 50. Disclosed during prosecution of US D587,381S issued ssued on Feb. 24, 2009.
Techo-Block, Slope & Splitface Block, Walls & Steps, p. 58. Disclosed during prosecution of US D587,381S which issued on Feb. 24, 2009.
Terracore Panels, Split-Tail Attachment, Jul. 15, 2010, Dallas, USA.
The Mold Store, How-to Guide to Make Lightweight Concrete and Cement Formulas for Stone Veneer and Man-Made Stones, website <www.themoldstore.info/concrete_formulas.html>, retrieved Mar. 12, 2012, 2 pages.
Thiele Geotech, Typical Details Engineering Drawings, Apr. 11, 2003, 2 pages.
Thiele Geotech, Typical Details Engineering Drawings, Apr. 30, 2003, 7 pages.
Thiele Geotech, Typical Details Engineering Drawings, May 6, 2003, 1 page.
Unilock, DuraHold®, website <www.consumer.unilock.com/products/product_line.php?pcid=4&prid=105>, retrieved Sep. 5, 2007, 2 pages.
Unilock, DuraHold2®, website <www.consumer.unilock.com/products/product_line.php?pcid=4&prid=106>, retrieved Sep. 5, 2007, 1 page.
Unilock, Siena Stone, website <www.consumer.unilock.com/products/product_line.php/pcid=4&prid=104>, retrieved Sep. 5, 2007, 2 pages.
United Lock Block, 1 page.
United Lock-Block, Field Construction Manual, website <www.unitedlockblock.com/docs/gravity.doc>, hand-dated Apr. 3, 2008, 6 pages.
Versa-Lok, Product Descriptions, website <www.versa-lok.com/homeowner/hProductDescript.htm>, retrieved Sep. 5, 2007, 3 pages.
Wood Haven, The Rainscreen Clip™, hand-dated Feb. 14, 2012, 1 page.
Wood Haven, Wood Siding for Use with the Rainscreen Clip™, 1 page.
Richway Industries, CreteFoamer™, 2007, 3 pages, Jansville, USA.

* cited by examiner

NATURAL ROCK PANEL, NATURAL ROCK VENEER PANEL AND PANEL SUPPORT APPARATUS

CROSS REFERENCE TO RELATED APPLICATIONS

This application is the U.S. National Phase of International Application No. PCT/CA2012/000355, filed Apr. 18, 2012, designating the U.S. and published as WO/2012/149630 on Nov. 8, 2010 which claims the benefit of U.S. Provisional Patent Application No. 61/481,681, filed May 2, 2011.

BACKGROUND OF THE INVENTION

1. Field of Invention

This invention relates to architectural finish elements and supporting apparatus therefor, and more particularly to architectural finish elements that employ real rock configured in a lightweight panel form. The invention also relates to apparatus for supporting architectural finish panels including the type that employ real rock configured in a lightweight panel form.

2. Description of Related Art

Various architectural finish elements have been used over the years to clad architectural structures such as buildings. Some of these architectural finish elements involve individual stone elements, individually secured to the architectural structure. Installation of this type of element is time-consuming, and such elements can be susceptible to release from the surface due to thermal expansion and contraction, which can loosen mortar adhesion systems that secure such elements to an architectural structure for example. Further, such individually secured stone elements are often joined by mortar joints having thicknesses of about ⅜ inches or more, and such mortar joints may have an undesirable appearance.

Some inventors have overcome the mortar adhesion problem by cutting grooves into the individual stone elements and using a support clip that cooperates with the groove to support the individual stone element, but this tends to secure the stone elements rather rigidly to the surface of the architectural structure, which can still be a problem due to wind loading and seismic loading. Forces due to these conditions can result in displacement of the individual stone elements from the clips, resulting in release of one of more of the stone elements from the structure.

The appearance of dry-stacked individual stone elements (i.e. where there are no readily apparent joint lines between adjacent stone elements) is a highly desirable and attractive finish and is generally achieved only by actually dry stacking individual stone elements. Generally, individual stone elements are not aggregated together into unitary collections to form an architectural finish element because the stone elements themselves are generally relatively heavy such that any unitary collection of stone elements is generally too heavy to be lifted by a single person and would be too heavy to meet many building codes. To reduce weight, individual stone elements may sometimes be secured to a foam backing for example, but the foam can deform over time if subjected to point loading and can be susceptible to ultraviolet radiation degradation and can present challenges for fire proofing.

Artificially formed surfaces comprised of concrete painted and molded to look like a dry-stacked arrangement of individual stone elements have been used on foam to form building blocks but are still too heavy and therefore not suitable for cladding a building. Patio and walkway surfaces have been paved by masonry panels comprising a reinforced series of masonry elements such as stone or brick pavers bound together by a cement or mortar-like material, but these too are too heavy for cladding an architectural structure.

SUMMARY OF THE INVENTION

In accordance with one aspect of the invention, there is provided an architectural finish element operable to be placed adjacent similar architectural finish elements to form a finished surface on an architectural structure. The architectural finish element includes a body formed of a rock-based composite material including a low density solid particle additive. The architectural finish element also includes a plurality of unitary real stone veneer elements bonded to the body in courses extending in a first direction and in a random non-repetitive pattern, the real stone veneer elements having respective face surfaces generally lying in a plane to form an overall face surface of the architectural finish element. The low density solid particle additive is provided in an amount suitable to cause the architectural finish element to have a density of between about 10 pounds per square foot to about 15 pounds per square foot.

The real stone veneer elements may have a density of between about 8 pounds per square foot to about 11 pounds per square foot.

The solid particle additive may include at least one of recycled waste, non-toxic waste, post manufacturing waste, and post consumer waste.

The solid particle additive may include lightweight synthetic particles.

The lightweight synthetic particles may include polymer particles.

The body may include about 25% to about 50% of the low density solid particle additive by volume.

The rock-based composite material may include pumice and cement.

The rock-based composite material may have a density of no more than about 4 pounds per square foot.

The body may have top, bottom and left and right edges and the left and right edges may have complementary shapes for engaging with corresponding right and left edges of left and right adjacent similar architectural finish elements respectively.

The left and right edges of the body may have a complementary stepped-shape.

The plurality of unitary real stone veneer elements may be bonded to the body such that a spacing between adjacent courses is generally between 0 inches to about ¼ inches to cause the real stone veneer elements forming the overall face surface to have a dry-stacked appearance.

The body may have a bottom edge and the courses of the unitary real stone veneer elements may be bonded to the body such that upper and lower edges of left side veneer elements adjacent the left edge of the body are generally the same distance from the bottom edge of the body as corresponding upper and lower edges of right side veneer elements adjacent the right edge of the body such that when a left edge of a first similarly configured adjacent architectural finish element is engaged with the right edge of the architectural finish element, corresponding courses of real stone veneer elements are aligned to create the appearance of continuous courses of the real stone veneer elements across the architectural finish element and the similarly configured adjacent architectural finish element and such that when a right edge of a second similarly configured adjacent architectural finish element is engaged with the left edge of the architectural finish element corresponding courses of real stone veneer elements are aligned to create the appearance of continuous courses of the real stone veneer elements across the architectural finish element and the second architectural finish element.

The top and bottom edges may have top and bottom profiles respectively for cooperating with support apparatus to secure the architectural finish element to the architectural structure.

The body may have a rear portion disposed opposite the face surface and the rear portion may include an integral moisture path interference structure operably configured to interfere with seepage of moisture from between adjacent such architectural finish elements toward the architectural structure.

The moisture path interference structure may include a rear surface opposite the face surface, on the body, the rear surface including generally planar portions and a plurality of parallel spaced apart spacers extending between the top and bottom edges of the body.

The spacers may include dovetailed tenons.

At least some of the dovetailed tenons may have a recess to receive a portion of a mounting element.

At least some of the dovetailed tenons may be spaced apart between the top and bottom edges to form air passageways that may permit air to move in a direction generally parallel to the direction of the courses of the real stone veneer.

In accordance with another aspect of the invention, there is provided an architectural finishing method. The method involves mounting a mounting portion of a body of at least one dual architectural finish element support to a surface of an architectural structure, and causing a first holder on the body to hold a portion of a bottom edge of a first architectural finish element in a first holder. The method also involves causing a second holder on the body to hold a portion of a top edge of a second architectural finish element adjacent to the bottom edge of the first architectural finish element and in alignment with the bottom edge of the first architectural finish element such that finish surfaces of the first and second architectural finish elements are generally coplanar. The method also involves causing the body to absorb mechanical forces between the first and second architectural finish elements and the architectural structure.

The first and second holders may hold the bottom edge of the first architectural finish element and the top edge of the second architectural finish element within about ¼ inches of each other.

Mounting may involve causing a flat surface of a sheet portion of the body to rest against the surface of the architectural structure.

Absorbing mechanical forces may involve causing a force absorbing member to be held by a holder on the body, in a position to absorb the mechanical loads between the body and the surface of the architectural structure.

Causing a force absorbing member to be held may involve causing a portion of the force absorbing member to be held in an opening in the sheet portion and between the guides on opposite sides of the opening.

Causing the force absorbing member to be held may involve aligning the force absorbing member in the opening and aligning the force absorbing member between the guides.

Aligning the force absorbing member may involve causing a flat outer surface of a projection on the force absorbing member, having a shape complementary to a shape of the opening to bear against the surface of the architectural structure and a holding portion of the force absorbing member, adjacent the projection and having first and second opposite end portions extending outwardly on opposite sides of the projection to overlap with corresponding margins of the sheet portion on opposite sides of the opening when the projection is received in the opening.

Absorbing the forces may involve causing a fastening bar having a bearing surface having a shape corresponding to a shape of the holding portion of the force absorbing portion and an opening for receiving a fastener to receive a fastener through the opening and through the force absorbing member such that the fastener bears against the fastening bar to cause the bearing surface of the fastening bar to bear against the holding portion to press the opposite ends of the holding portion against the margins of the sheet portion, while holding the projection in contact with the surface of the architectural structure, such that differences in forces between the sheet portions and the surface of the architectural structure are absorbed by the force absorbing member.

Absorbing the force may involve causing a resilient body acting as the force absorbing member to resiliently deform in response to forces between the surface of the architectural structure and the mounting portion.

The resilient body may be comprised of Neoprene.

Causing the first holder on the body to hold a portion of a bottom edge of the first architectural finish element may involve causing a first projection on the first holder to be received in a groove in a bottom edge of the first architectural finish element.

The method may further involve causing the first holder to hold the edge of the first architectural finish element in a position spaced apart from the surface of the architectural structure.

The method may further involve receiving the edge of the first architectural finish element in a first receptacle defined by a first set of bent portions in a unitary piece of sheet metal acting as the body.

The method may further involve causing coplanar distal edges of the guides to touch a cooperating surface on a back side of the architectural finish element to position the first architectural finish element.

The method may further involve causing a second projection on the body to bear against a portion of the top edge of the second architectural finish element.

In accordance with another aspect of the invention, there is provided a dual architectural finish element support apparatus including a body. The body includes a mounting portion facilitating mounting the second body to a surface of an architectural structure, a first holder operably configured to hold a portion of a bottom edge of a first architectural finish element, a second holder operably configured to hold a portion of a top edge of a second architectural finish element adjacent to the bottom edge of the first architectural finish element and in alignment with the bottom edge of the first architectural finish element such that finish surfaces of the first and second architectural finish elements are generally coplanar, and a load absorber operably configured to absorb mechanical forces between the mounting portion and the architectural structure.

The first and second holders may hold the bottom edge of the first architectural finish element and the top edge of the second architectural finish element within about ¼ inches of each other.

The mounting portion may include a sheet portion having a flat surface for resting against the surface of the architectural structure.

The load absorber may include a force absorbing member, and the sheet portion may have a force absorbing member holder for holding the force absorbing member in a position to absorb the mechanical loads between the body and the surface of the architectural structure.

The force absorbing member holder may include a wall defining an opening in the sheet portion and guides extending from the wall and disposed adjacent the opening for holding a portion of the force absorbing member in the opening and between the guides.

The force absorbing member may include a first aligner operably configured to align the force absorbing member in the opening and a second aligner operably configured to align the force absorbing member against the guides.

The first aligner may include a projection on the force absorbing member. The projection may have a flat outer surface for bearing against the surface of the architectural structure and may have a shape complementary to a shape of the opening. The second aligner may include a holding portion on the force absorbing member adjacent the projection and having first and second opposite end portions extending outwardly on opposite sides of the projection such that the first and second opposite ends overlap with corresponding margins of the sheet portion on opposite sides of the opening when the projection is received in the opening.

The load absorber may further include a fastening bar having a bearing surface having a shape corresponding to a shape of the holding portion of the force absorbing portion, and the fastening bar may have an opening for receiving a fastener operable to extend through the fastening bar and through the force absorbing member such that the fastener bears against the fastening bar to cause the bearing surface of the fastening bar to bear against the holding portion to press the opposite ends of the holding portion against the margins of the sheet portion, while holding the projection in contact with the surface of the architectural structure, such that differences in forces between the sheet portions and the surface of the architectural structure may be absorbed by the force absorbing member.

The force absorbing member may include a resilient body resiliently deformable in response to forces between the surface of the architectural structure and the mounting portion.

The resilient body may be comprised of Neoprene.

The body of the architectural finish element support apparatus may be formed of a unitary piece of sheet metal bent into a form defining the mounting portion, the first holder and the second holder.

The first holder may include a first projection operably configured to be received in a groove in a bottom edge of the first architectural finish element.

The first holder may include a first receptacle spaced apart from the mounting portion, for holding the edge of the first architectural finish element in a position spaced apart from the surface of the architectural structure.

The first receptacle may be defined by a first set of bent portions of the unitary piece of sheet metal.

The guides may have coplanar distal edges lying in a plane spaced apart from the first projection by a distance enabling the coplanar distal edges to touch a cooperating surface on a back side of the first architectural finish element.

The second holder may include a second projection operably configured to bear against a portion of a top edge of the second architectural finish element.

In accordance with another aspect of the invention, there is provided an architectural finishing system. The system includes first and second architectural finish elements of the type described above, and at least one dual architectural finish element support system including a second body. The second body includes a mounting portion facilitating mounting the second body to a surface of an architectural structure, a first holder operably configured to hold a portion of a bottom edge of the first architectural finish element, and a second holder operably configured to hold a portion of a top edge of the second architectural finish element adjacent to the bottom edge of the first architectural finish element and in alignment with the bottom edge of the first architectural finish element such that finish surfaces of the first and second architectural finish elements are generally coplanar. The at least one dual architectural finish element support system also includes a load absorber operably configured to absorb mechanical forces between the mounting portion and the architectural structure.

The first and second holders may hold the bottom edge of the first architectural finish element and the top edge of the second architectural finish element within about ¼ inches of each other.

The mounting portion may include a sheet portion having a flat surface for resting against the surface of the architectural structure.

The load absorber may include a force absorbing member, and the sheet portion may have a force absorbing member holder for holding the force absorbing member in a position to absorb the mechanical loads between the mounting portion and the surface of the architectural structure.

The force absorbing member holder may include a wall defining an opening in the sheet portion and guides extending from the wall and disposed adjacent the opening for holding a portion of the force absorbing member in the opening and between the guides.

The force absorbing member may include a first aligner operably configured to align the force absorbing member in the opening and a second aligner operably configured to align the force absorbing member against the guides.

The first aligner may include a projection on the force absorbing member. The projection may have a flat outer surface for bearing against the surface of the architectural structure and may have a shape complementary to a shape of the opening. The second aligner may include a holding portion on the force absorbing member adjacent the projection and having first and second opposite end portions extending outwardly on opposite sides of the projection such that the first and second opposite ends overlap with corresponding margins of the sheet portion on opposite sides of the opening when the projection is received in the opening.

The load absorber may further include a fastening bar having a bearing surface having a shape corresponding to a shape of the holding portion of the force absorbing portion, and the fastening bar may have an opening for receiving a fastener operable to extend through the fastening bar and through the force absorbing member such that the fastener bears against the fastening bar to cause the bearing surface of the fastening bar to bear against the holding portion to press the opposite ends of the holding portion against the margins of the sheet portion, while holding the projection in contact with the surface of the architectural structure, such that differences in forces between the sheet portions and the surface of the architectural structure are absorbed by the force absorbing member.

The force absorbing member may include a resilient body resiliently deformable in response to forces between the surface of the architectural structure and the mounting portion.

The resilient body may be comprised of Neoprene.

The body of the architectural finish element support system may be formed of a unitary piece of sheet metal bent into a form defining the mounting portion, the first holder and the second holder.

The first holder may include a first projection operably configured to be received in a groove in a bottom edge of the first architectural finish element.

The first holder may include a first receptacle spaced apart from the mounting portion, for holding the edge of the first architectural finish element in a position spaced apart from the surface of the architectural structure.

The first receptacle may be defined by a first set of bent portions of the unitary piece of sheet metal.

The guides may have generally coplanar distal edges lying in a plane spaced apart from the first projection by a distance enabling the coplanar distal edges to touch a cooperating surface on a back side of the architectural finish element.

The second holder may include a second projection operably configured to bear against a portion of a top edge of the second architectural finish element.

In accordance with another aspect of the invention, there is provided an architectural finish element operable to be placed adjacent similar architectural finish elements to form a finished surface on an architectural structure. The architectural finish element includes a body formed of a plurality of unitary real stone elements adhesively secured together in courses, the real stone elements having respective face surfaces generally lying in a front plane to form an overall face surface of the architectural finish element and having respective rear surfaces generally lying in a rear plane facing in a direction opposite the face surface. The plurality of unitary real stone elements are arranged to form left and right edges each having complementary stepped-shapes and generally parallel top and bottom edges. The courses are parallel with the top and bottom edges and the stone elements at the left edge are of similar thickness and are disposed at the same distance from the bottom edge as corresponding stone elements at the right edge so that courses on left and right adjacently placed similar architectural finish elements are aligned with the courses of the real stone elements of the body.

The body may have a density of no more than about 15 pounds per square foot.

The rear surface may be flat planar, and may support a mesh backing or have grooves cut therein to cooperate with mortar to secure the architectural finish element to said architectural structure.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
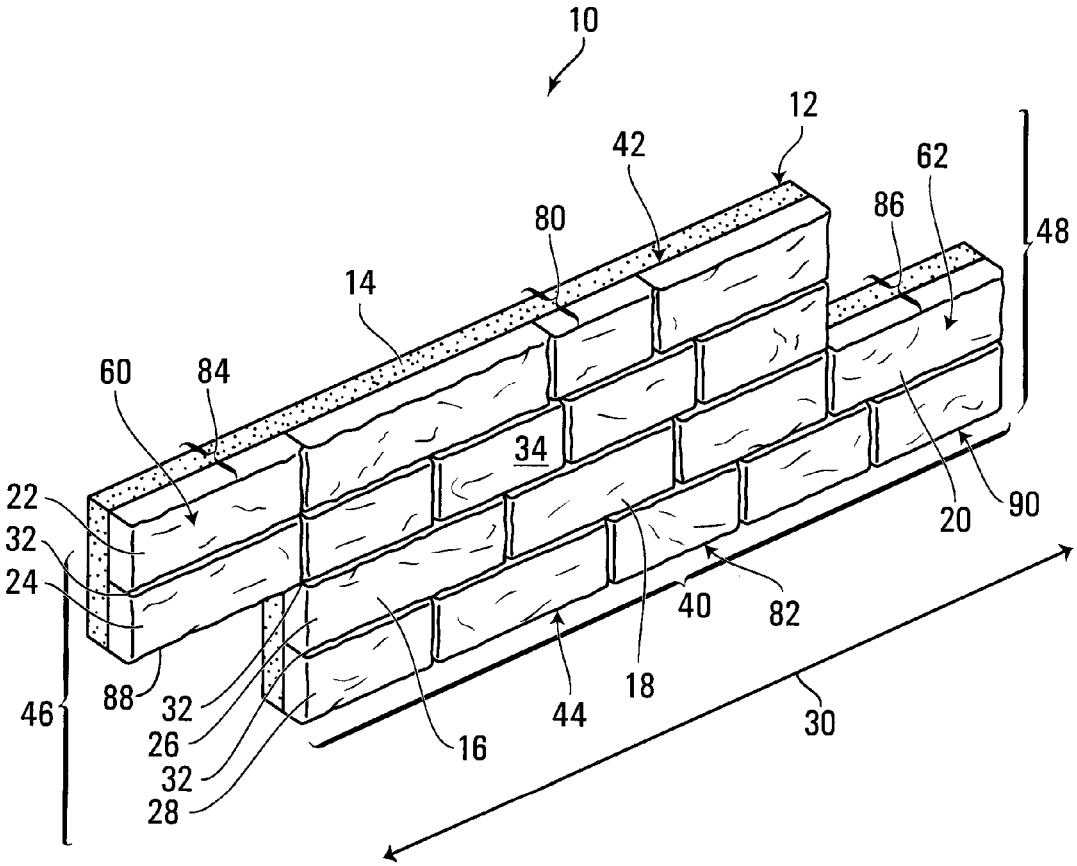
FIG. 1 is a perspective view of an architectural finish element according to a first embodiment of the invention.

Referring to FIG. 1, an architectural finish element operable to be placed adjacent similar architectural finish elements to form a finished surface on an architectural structure is shown generally at 10. The architectural finish element 10 is in the form of a panel and comprises a body 12 formed of a rock-based composite material comprising a low density solid particle additive 14 and a plurality of unitary real stone veneer elements, such as shown at 16, 18 and 20 for example, bonded to the body.

In this embodiment, the rock-based composite material forming the body 12 is comprised of Portland cement mixed with water and an aggregate comprised of pumice in a ratio of 1.5:1:2. In this embodiment, the veneer elements, such as shown at 16, 18 and 20 for example, may be bonded to the body 12 by casting the body adjacent the veneer elements.

The solid particle additive 14 may be recycled waste, non-toxic waste, post manufacturing waste, or post consumer waste, for example, such as is available under the trade name Re-Ad from CLP Technologies, LLC of Seattle, Wash., USA.

Alternatively, or in addition, the solid particle additive 14 may comprise lightweight synthetic particles such as polymer particles available from Syntheon Inc. of Moon Township, Pa., USA under the trade name Elemix.

The body 12 is formed such that it comprises about 25% to about 50% of the low density solid particle additive 14 by volume and such that the rock-based composite material and the low density solid particle additive are provided in amounts suitable to cause the body to have a density of no more than about 4 pounds per square foot. The real stone veneer elements 16, 18, 20 are cut thinly such that they add no more than about 6 to 11 pounds per square foot so that the completed architectural finish element will have a density of between about 10 pounds per square foot to about 15 pounds per square foot. This provides a panel of a weight suitable for manipulation by most persons and one that complies with most building codes.

At the time of manufacture, the unitary real stone veneer elements 16, 18, 20 are bonded to the body 12 in courses 22, 24, 26, 28, for example, extending in a first direction 30 and in a random non-repetitive pattern. The real stone veneer elements 16, 18, 20 are bonded to the body 12 such that a spacing 32 between adjacent courses is generally between 0 inches to about ¼ inches and such that respective face surfaces of the unitary real stone veneer elements generally lie in a common plane to form an overall face surface 34 of the architectural finish element, causing it to have a dry-stacked appearance. A dry-stacked appearance is one in which the individual stone veneer elements 16, 18, 20 are arranged so closely together that there are no "mortar" lines or "mortar joints", i.e. gaps between adjacent such elements.

Figure 2:
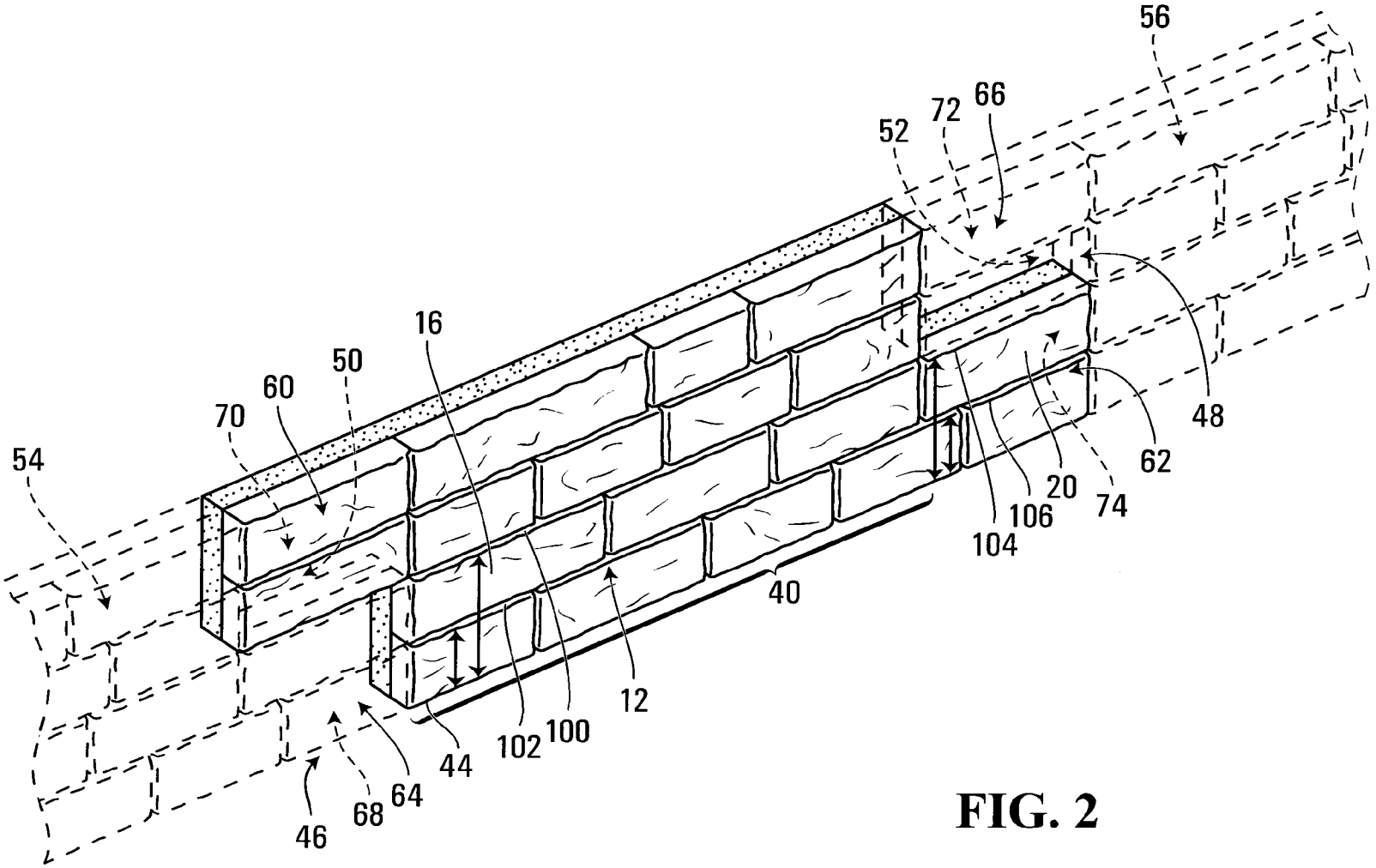
FIG. 2 is a perspective of the architectural finish element of FIG. 1, shown with left and right adjacent similar architectural finish elements engaged therewith.

Still referring to FIG. 1, the body 12 has a main portion 40 and top, bottom, and left and right edges 42, 44, 46 and 48. Referring to FIG. 2, the left and right edges 46, 48 have complementary shapes for engaging with corresponding right and left edges 50 and 52 of left and right adjacent similar architectural finish elements 54, 56 respectively. In the embodiment shown, the left and right edges 46, 48 of the body 12 have a complementary stepped-shape, wherein the left edge has an upper projection 60 and the right edge has a lower projection 62, both projecting from opposite ends of the main portion 40 by the same distance, so as to form a lower receptacle 64 on the left side of the main portion and an upper receptacle 66 on the right side of the main portion. This permits a lower projection 68 of the adjacent left element 54 to be received in the lower receptacle 64, while the upper projection 60 of the left edge 46 is received in an upper receptacle 70 of the adjacent left element 54. Similarly, an upper projection 72 of the adjacent right element 56 is received in the upper receptacle 66, while the lower projection 62 of the right edge is received in the lower receptacle 74 of the adjacent right element 56.

Figure 3:
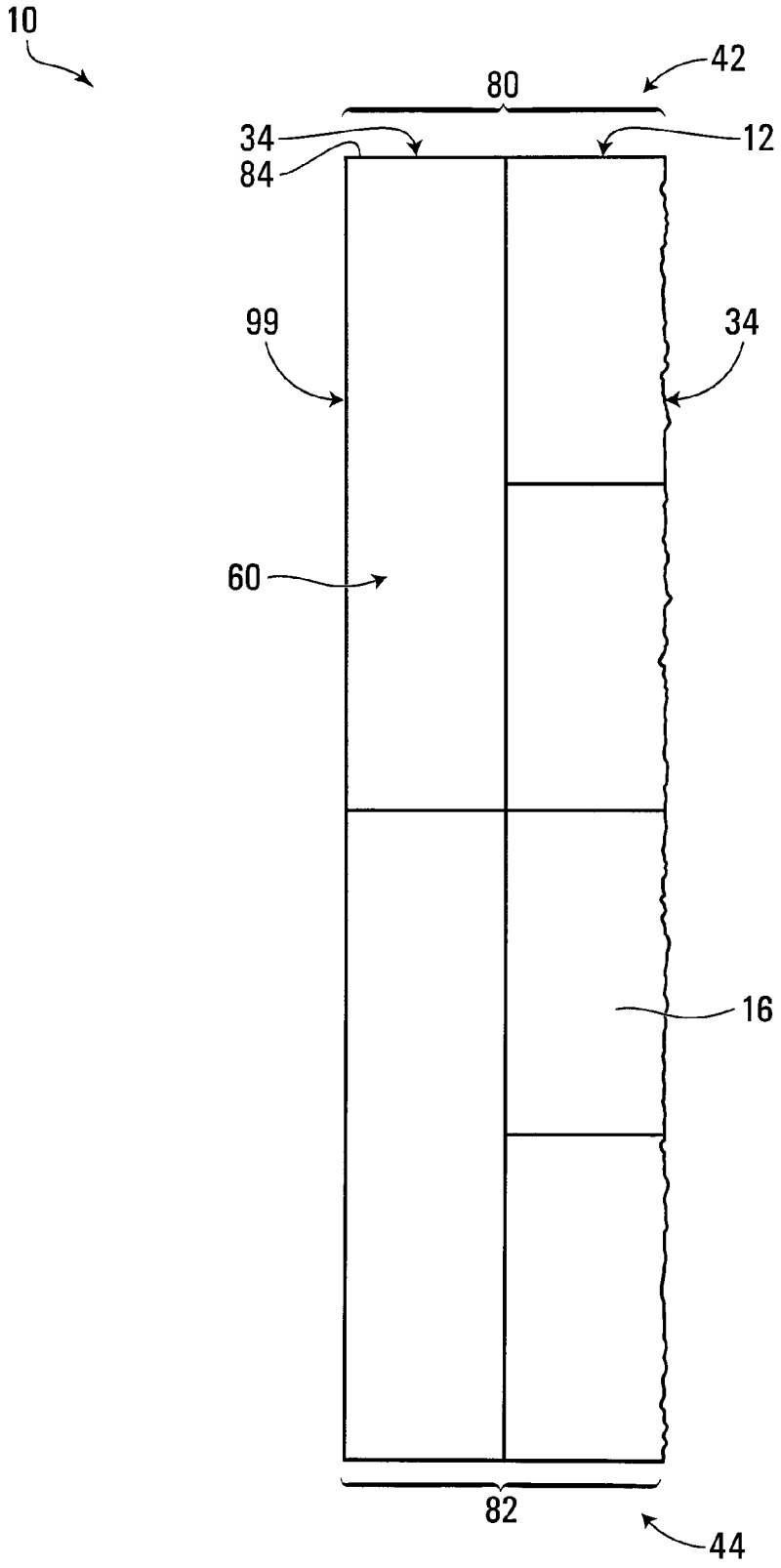
FIG. 3 is a left side view of the architectural finish element shown in FIG. 1.

Referring to FIG. 3, which is an end view of the left edge 46, the top and bottom edges 42 and 44 have top and bottom edge profiles 80 and 82 respectively. Referring back to FIG. 1, the top edge profile 80 extends along the main portion of the body 12 and along a top portion 84 of the upper projection 60 on the left edge 46 of the body 12 and along a top portion 86 of the lower projection 62 on the right edge 48 of the body. The bottom edge profile 82 extends along the main portion 40 of the body 12 and along a bottom portion 88 of the upper projection 60 on the left edge 46 of the body and along a bottom portion 90 of the lower projection 62 on the right edge 48 of the body. In the embodiment shown, the top and bottom edge profiles 80 and 82 are flat planar surfaces that permit the top and bottom edges of adjacent architectural finish elements to be butted up against each with no readily visible joint line.

Referring back to FIG. 3, the body 12 further has a rear portion 99 disposed opposite the face surface. The rear portion faces the architectural structure on which the architectural finish element is to be mounted. The rear portion has a rear surface opposite the face surface of the body. The rear surface is generally flat planar.

The architectural finish element may be directly secured to a flat surface of the architectural structure by placing wet mortar on the flat surface and then setting the architectural finish element into the mortar, like a wall title.

The above-described architectural finish element provides a body 12 with an overall face surface 34 provided by a unitary collection of real stone veneer elements 16, 18, 20 having a dry-stacked appearance. In the embodiment shown, the overall length of the architectural finish element is about 30 inches and the height is about 8 inches. Each projection 60 and 62 extends about 4 inches from the main body and has a height of about 4 inches. The use of an architectural finish element according to the specific embodiment described provides about 1.33 square feet of coverage to the architectural structure and can be applied as a unit, avoiding individual placement of real stone veneer directly on the architectural structure. This enables rapid application of a finishing surface or outer cladding to an architectural structure 1.33 square feet at a time, rather than direct application of real stone veneer elements that cover only a few square inches at a time, while still achieving a dry-stacked appearance.

Figure 4:
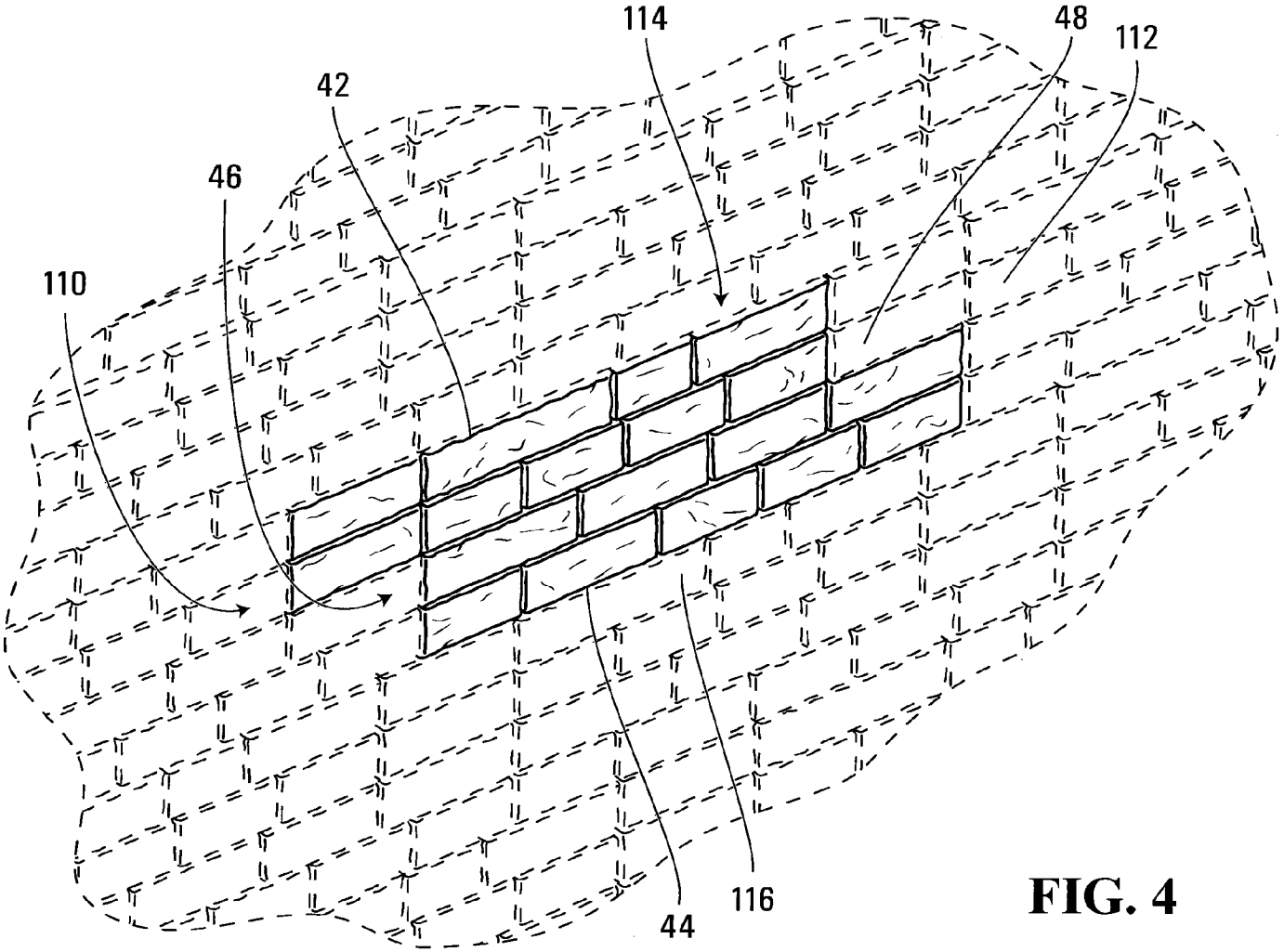
FIG. 4 is an oblique view of the architectural finish element shown in FIG. 1 with adjacent left and right and top and bottom similar architectural finish elements to form an overall cladding on an architectural structure.

The courses of the unitary real stone veneer elements 16, 18, 20 are bonded to the body 12 such that upper and lower edges 100 and 102 of left side veneer elements, one of which is shown at 16 adjacent the left edge 46 of the body 12, are generally the same distances from the bottom edge 44 of the body as corresponding upper and lower edges 104 and 106 of veneer elements adjacent the right edge 48 of the body such that when the left edge 52 of a first similarly configured adjacent architectural finish element 56 is engaged with the right edge 50 of the architectural finish element 10, corresponding courses of real stone veneer elements 16, 18, 20 are aligned to create the appearance of continuous courses of the real stone veneer elements across the architectural finish element 10 and the similarly configured adjacent architectural finish element 56. Similarly, when a right edge 50 of a second similarly configured adjacent architectural finish element 54 is engaged with the left edge 46 of the architectural finish element 10, corresponding courses of real stone veneer elements are aligned to create the appearance of continuous courses of the real stone veneer elements across the architectural finish element and the second architectural finish element 54. In addition, referring to FIG. 4, due to the engagement of the stepped left and right edges 46 and 48 with left and right adjacent architectural finish elements 110 and 112 and due to the abutment of the top and bottom edges 42 and 44 with adjacent upper and lower architectural finish elements 114 and 116, and due to the consistent placement of the real stone veneer elements in courses aligned at each edge, when a plurality of such architectural finish elements are engaged as shown to form an overall surface on the architectural structure, the resulting overall surface has a consistent, uniform dry-stacked appearance with the randomness of stones in respective courses, but with the regularity of courses along the entire length of the finished surface.

Figure 5:
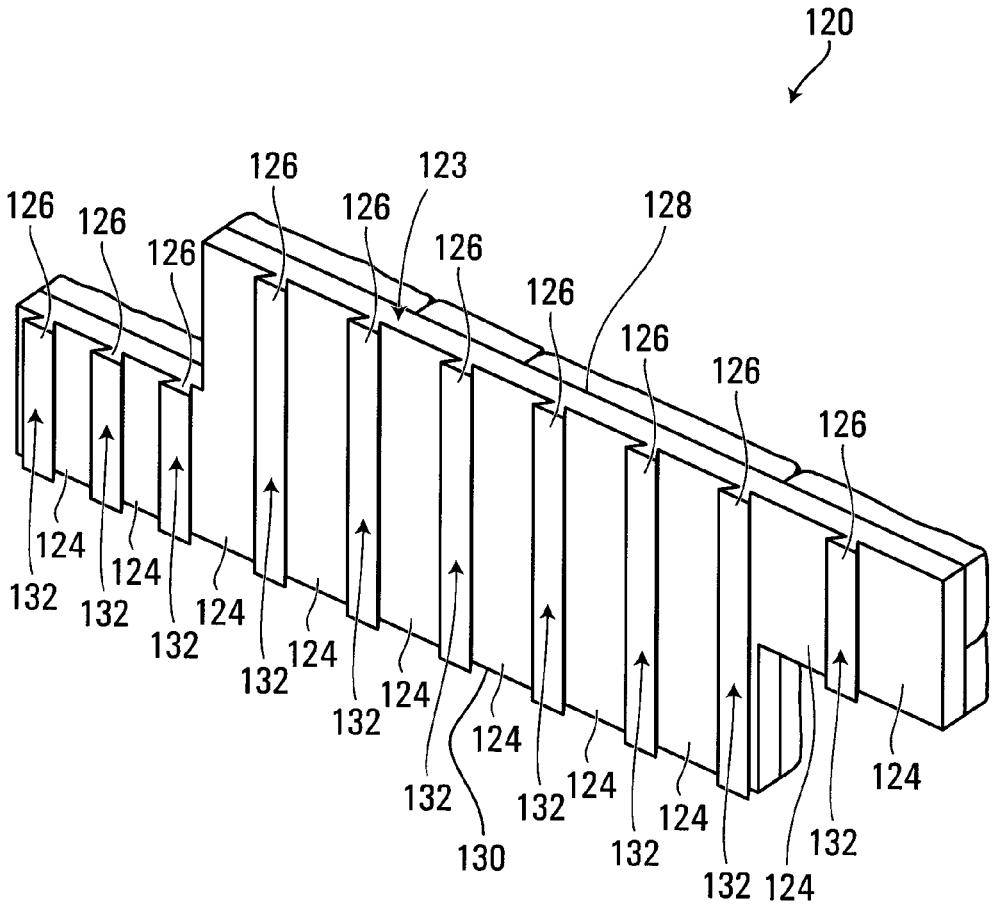
FIG. 5 is an oblique view of the architectural finish element of the type shown in FIG. 1, with an alternate rear surface.

In the embodiment shown in FIGS. 1 to 4, the rear surface is flat planar. Referring to FIG. 5, in an alternative embodiment, there is provided an architectural finish element as shown at 120, which is the same as the architectural finish element shown in FIGS. 1 to 4 but has a body 123 having a rear surface that is formed to have a plurality of generally coplanar portions 124 and a plurality of parallel spaced apart spacers 126 extending between top and bottom edges 128 and 130 of the body. In the embodiment shown, the spacers 126 comprise dovetailed tenons each having an outer surface 132 operable to contact a surface the architectural structure to which the associated architectural finish element 120 is to be secured.

The architectural finish element 120 may be directly secured to a flat surface of the architectural structure by placing wet mortar on the flat surface and then setting the architectural finish element into the mortar such that the mortar becomes disposed between adjacent tenons and in contact therewith. When the mortar sets, it takes the shape of a complementary dovetail engaged with the dovetailed tenons of the architectural finish element and thus the dovetailed tenons of the architectural finish element are held securely by the mortar, which causes the architectural finish element to be secured to the surface of the architectural structure.

Figure 6:
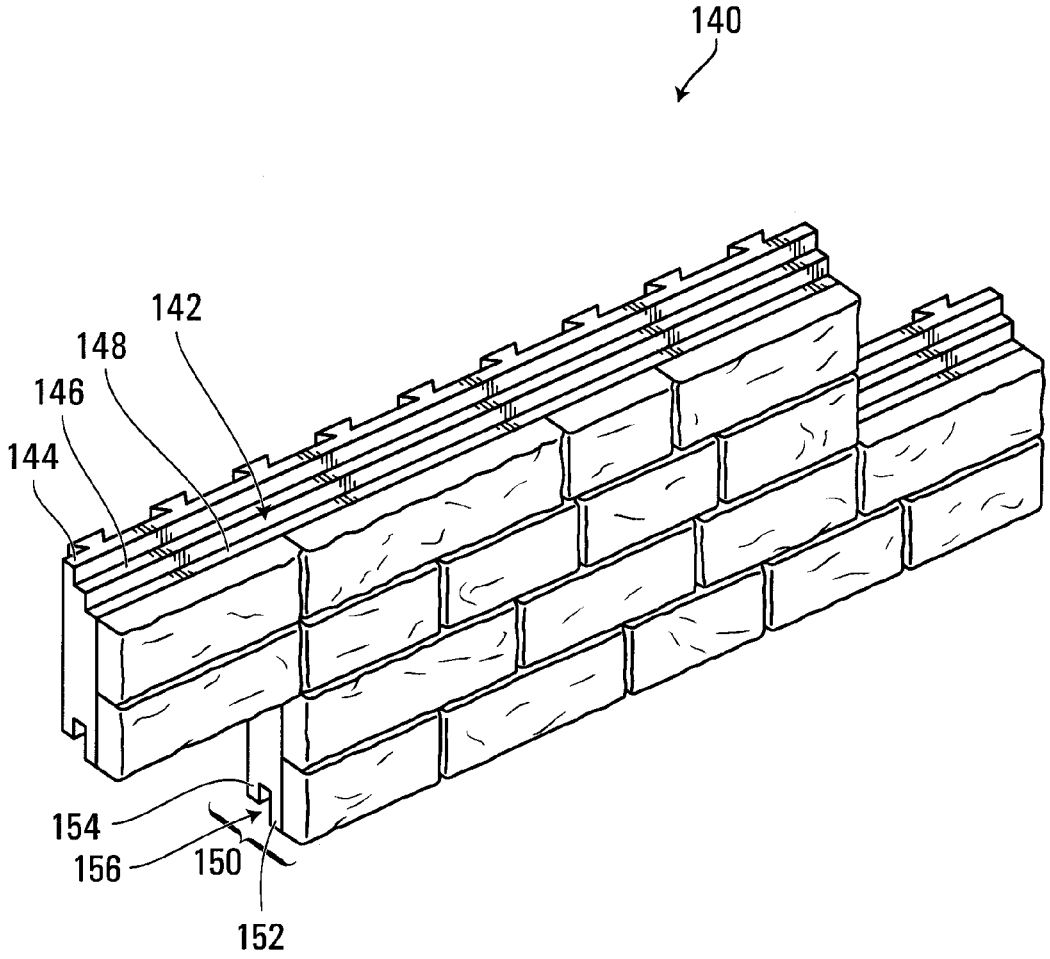
FIG. 6 is an oblique view of an architectural finish element according to a second embodiment of the invention.
Figure 7:
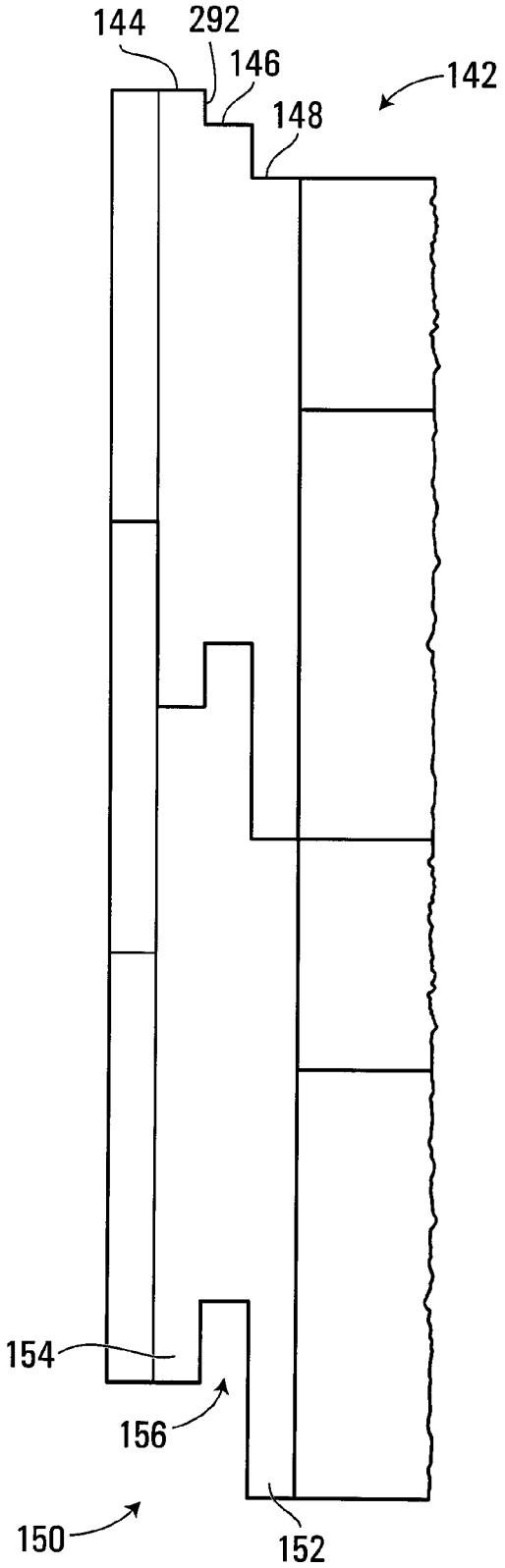
FIG. 7 is a left side view of the architectural finish element shown in FIG. 6.
Figure 8:
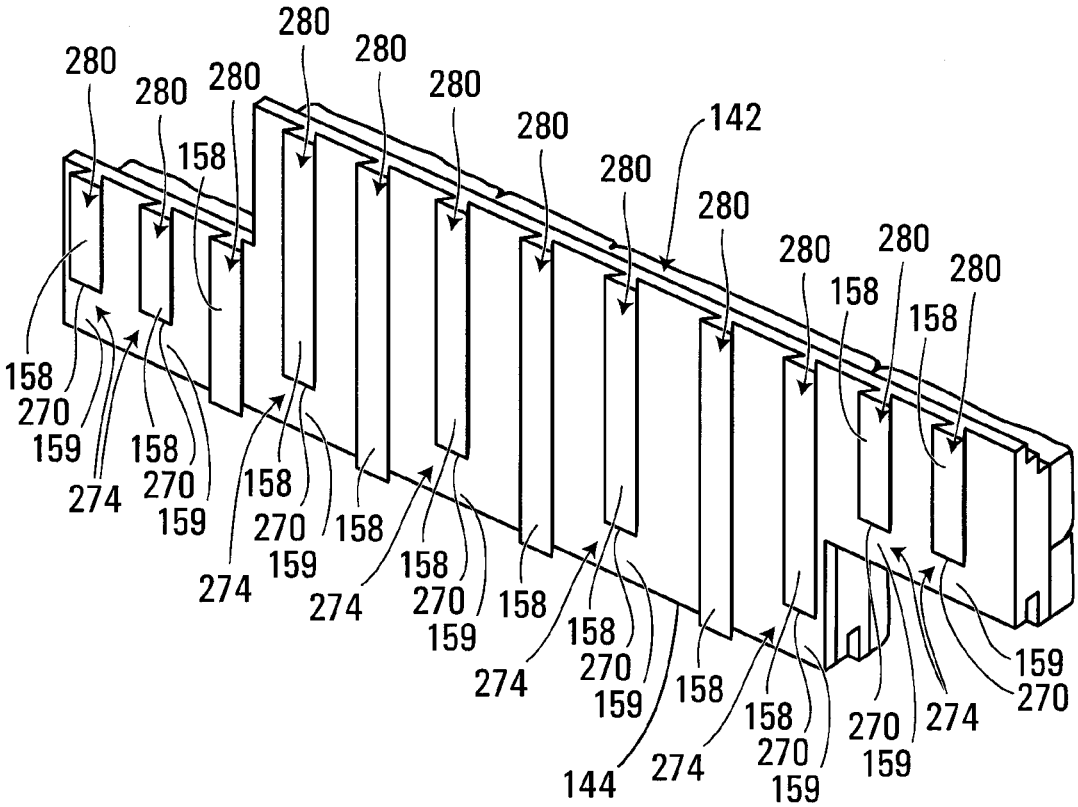
FIG. 8 is a rear perspective of the architectural finish element shown in FIG. 6.

Referring to FIG. 6 an architectural finish element according to a third embodiment is shown generally at 140. Referring to FIGS. 6 and 7 the architectural finish element 140 according to this embodiment is the same as that of the second embodiment with the exception that it has, a top edge 142 having a profile that includes first, second and third flat top surfaces 144, 146, 148 arranged in a step pattern and has a bottom edge 150 having a profile that includes generally rectangular outer and inner projections 152 and 154 spaced apart by a generally rectangular groove 156. These profiles of the top and bottom edges 142 and 150 enable the use of a dual architectural finish element support apparatus, such as shown at 160 in FIGS. 9 and 10 according to another aspect of the invention, to be used to secure the architectural finish element 140 to the surface of the architectural structure. Also, to facilitate the use of the dual architectural finish element support apparatus 160, the dovetailed tenons 158 have recesses 159 as shown in FIG. 8.

Figure 9:
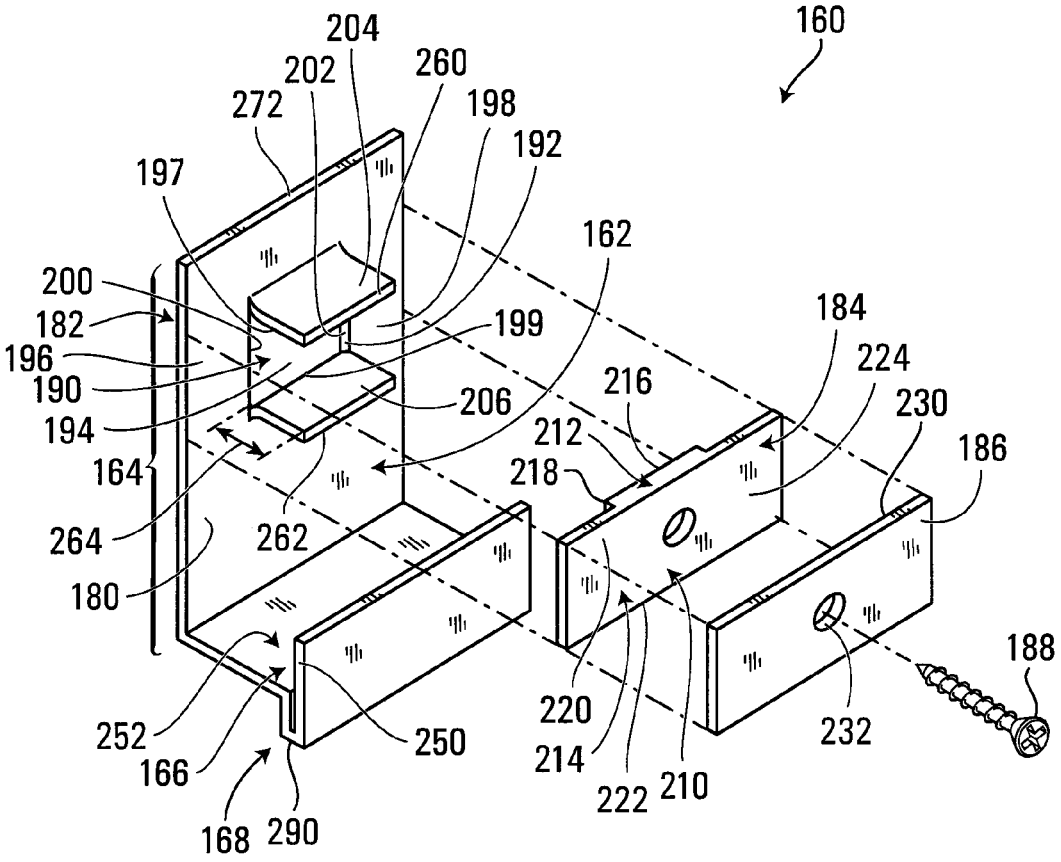
FIG. 9 is a perspective view of a dual architectural finish element support apparatus according to another embodiment of the invention.
Figure 10:
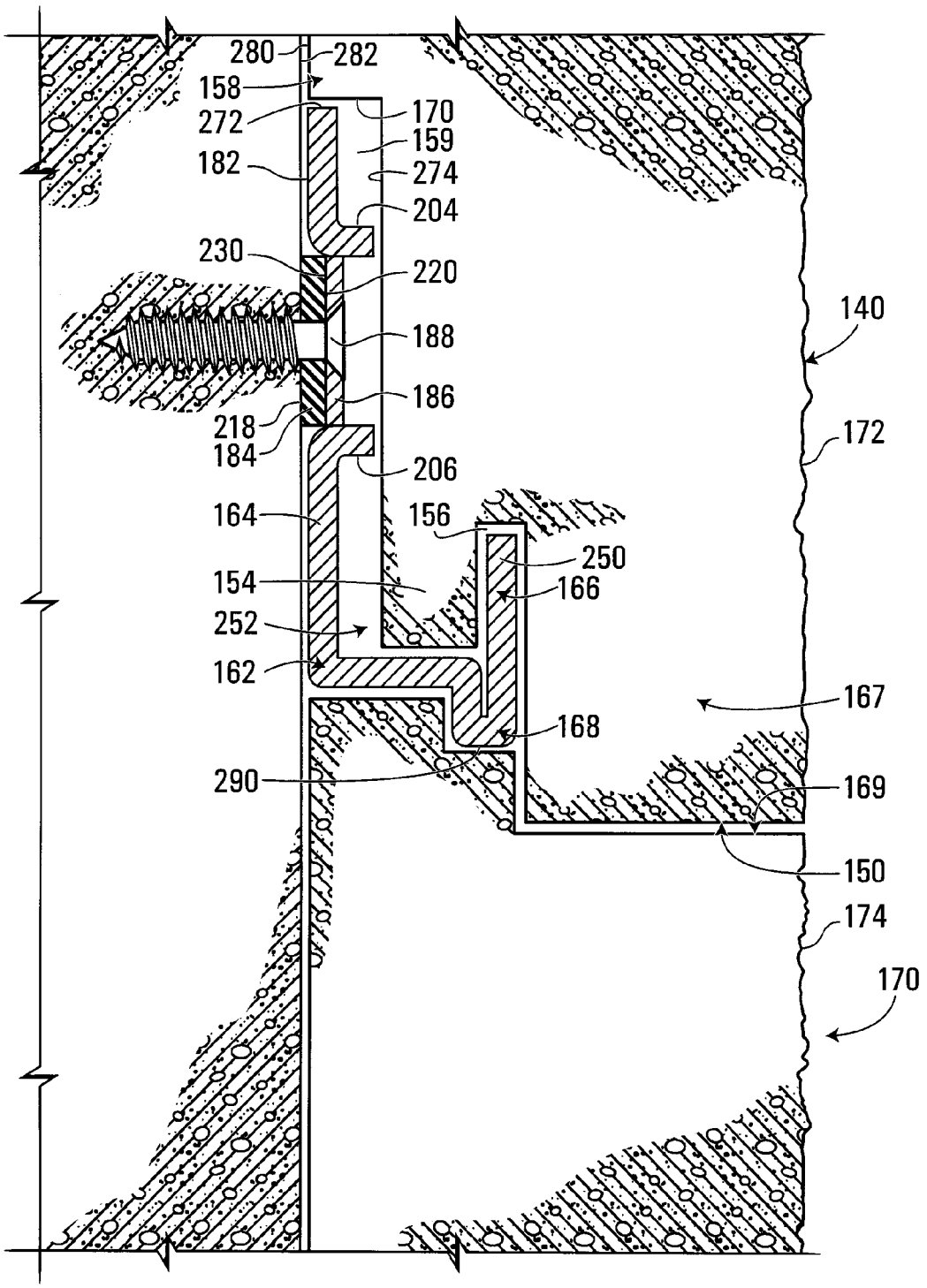
FIG. 10 is a cross-sectional view of the dual architectural finish element of FIG. 9, shown fastened to an architectural structure and supporting first and second architectural finish elements.
Figure 11:
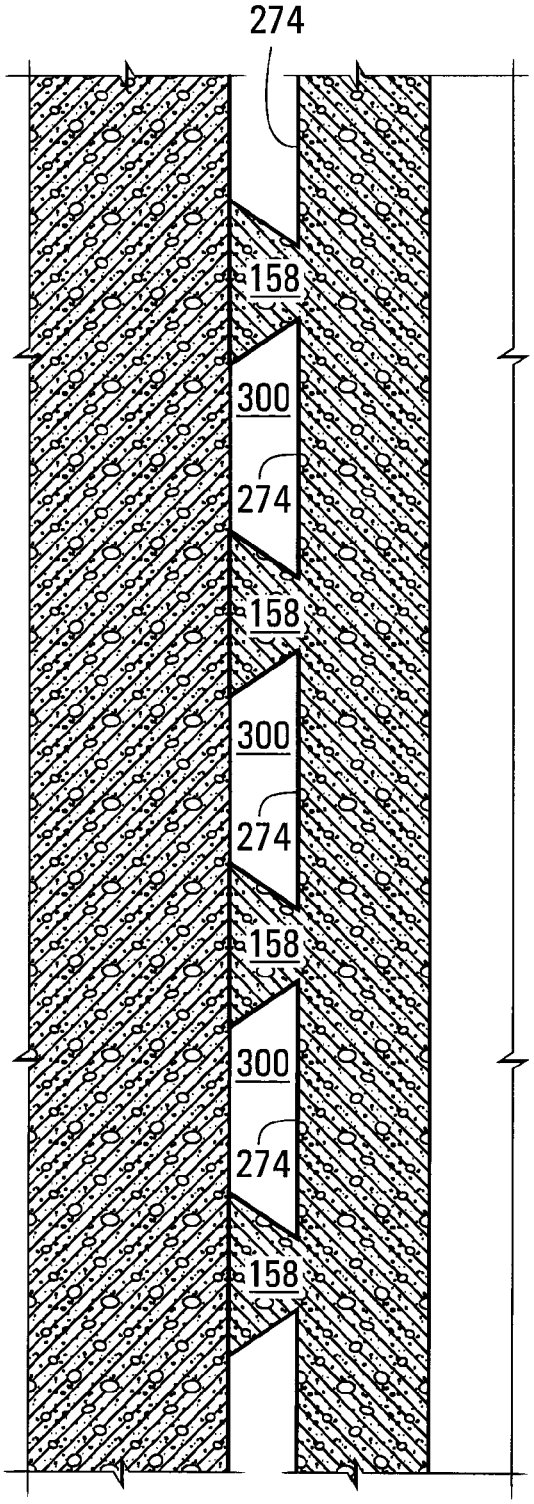
FIG. 11 is a cross-sectional top view of the architectural finish element shown in FIG. 8, secured to an architectural structure.

Referring to FIGS. 9 and 10, the dual architectural finish element support apparatus 160 comprises a second body 162 having a mounting portion 164 facilitating mounting the second body to the surface of the architectural structure, a first holder 166 operably configured to hold a portion of a bottom edge 167 of the first architectural finish element shown at 140 in FIG. 6 and a second holder 168 operably configured to hold a portion of the top edge 169 of a second architectural finish element 170 of the type shown in FIG. 6, adjacent to the bottom edge 167 of the first architectural finish element 140 and in alignment with the bottom edge of the first architectural finish element such that finish surfaces 172 and 174 of the first and second architectural finish elements 140 and 170 are generally coplanar. The first and second holders 166 and 168 hold the bottom edge 167 of the first architectural finish element 140 and the top edge 169 of the second architectural finish element 170 within about ¼ inches of each other. Referring to FIG. 9, in the embodiment shown, the body of the architectural finish element support apparatus is formed of a unitary piece of sheet metal bent into a form defining the mounting portion 164, the first holder 166 and the second holder 168.

The mounting portion 164 comprises a generally planar sheet portion 180 of the sheet metal body having a flat surface 182, which in some embodiments may rest against the surface of the architectural structure, although in other embodiments the flat surface 182 may be spaced apart from the surface of the architectural structure. The mounting portion 164 cooperates with a load absorber shown generally at 183 that is operably configured to absorb mechanical forces between the mounting portion 164 and the architectural structure 11. The load absorber 183 includes a load absorbing member 184, a fastening bar 186 and a fastener 188 to secure the body 162 to the architectural structure.

Force Absorbing Member Holder

The mounting portion 164 includes a force absorbing member holder 190 formed into the mounting portion of the sheet metal body.

The force absorbing member holder 190 has a wall 192 defining an opening 194 in the mounting portion 164, such that portions of the sheet portion about the opening define margins 196 and 198 around the opening. In the embodiment shown the opening 194 has a rectangular shape with first and second long side portions 197 and 199 and first and second short side portions 200 and 202. The force absorbing member holder 190 also has first and second guides 204 and 206 extending in parallel spaced apart relation from the wall 192 and disposed adjacent the first and second long side portions 197 and 199 of the opening 194 for holding a portion of the force absorbing member 184 in the opening and for holding another portion thereof between the guides. The guides 204 and 206 may be formed by cutting an "h" form having a center cut into the planar mounting portion 164 of the body 162 and then bending solid portions on opposite sides of the "h" form to extend parallel to each other, perpendicularly to the plane of the mounting portion.

Force Absorbing Member

In this embodiment, the force absorbing member 184 comprises a resilient body 210 comprised of Neoprene. The resilient body is formed to include a first aligner 212 operably configured to align the force absorbing member 184 in the opening 194 and a second aligner 214 operably configured to align the force absorbing member 184 against the guides 204 and 206. The first aligner 212 includes a projection 216 on the force absorbing member 184, the projection 216 having a flat outer surface 218 for bearing against the surface of the architectural structure and having a shape complementary to the shape of the opening 194 which, in the embodiment shown, is rectangular. The second aligner 214 comprises a rectangular holding portion 220 on the force absorbing member adjacent the projection 216 and having first and second opposite end portions 222 and 224 extending outwardly on opposite sides of the projection 216 such that the first and second opposite end portions overlap with corresponding margins 196 and 198 of the sheet portion on opposite short side portions 200 and 202 of the opening 194 when the projection 216 is received in the opening 194.

The load absorber fastening bar 186 has a bearing surface 230 having a shape corresponding to the shape of the holding portion 220 of the force absorbing member (i.e. rectangular). The fastening bar 186 also has an opening 232 for receiving the fastener 188. The fastener 188 is operable to extend through the fastening bar 186 and through the force absorbing member 184 and into the surface of the architectural structure as shown in FIG. 10 such that the fastener engages with the architectural structure and, when tightened, bears against the fastening bar 186 to cause the bearing surface 230 of the fastening bar 186 to bear against the holding portion 220 of the force absorbing member 184 to press the opposite end portions 222 and 224 of the holding portion 220 against the margins 196 and 198 on opposite sides of the opening 194, while holding the flat surface 218 of the projection 216 in contact with the surface of the architectural structure.

First Holder

The first holder 166 includes a first projection 250 operably configured to project upwardly when in use and operable to be received in the groove 156 in the bottom edge 150 of the architectural finish element.

The first holder 166 also includes a first receptacle 252 spaced apart from the mounting portion 164 and terminated in the first projection 250. The first receptacle 252 holds a portion of the bottom edge 150 of the architectural finish element 140 in a position spaced apart from the surface of the architectural structure. More particularly, the first receptacle 252 holds the inner projection 154 on the bottom edge 150 of the architectural finish element, while the first projection 250 is received in the groove 156 between the inner and outer projections 154 and 152 on the bottom edge 150.

To facilitate use of the dual architectural finish element support apparatus 160 in areas of the architectural finish element 140 which have dovetailed tenons, at least some of the dovetailed tenons 158 are configured with a recess 159 to receive the guides 204 and 206 extending from the mounting portion 164. In this case, the tenons 158 are configured to extend from the top edge 142 of the architectural finish element 140 to near the bottom edge 150 but not completely to the bottom edge. Rather, lower end portions 270 of the tenons 158 are spaced apart from the bottom edge 150 by the distance between the first receptacle 252 and a top 272 of the mounting portion 164, leaving only a planar surface portion 274 of the rear surface of the architectural finish element exposed in this area. The enables the entire mounting portion 164 to be received in the space defined by the lower end portion 270 of the tenon 158, and the planar surface portion 274 between the lower end portion of the tenon and the bottom edge 150 of the architectural finish element. In addition, the guides 204 and 206 on the dual architectural finish element support apparatus 160 are configured such that their distal surfaces 260 and 262 extend a distance 264 from the generally planar sheet portion 180 to touch the flat planar surface 274 between the lower end portion 270 of the tenon 158 and the bottom edge 167 of the architectural finish element 140. In addition, distal flat surfaces 280 of the tenons 158 touch the flat surface 282 of the architectural structure. This provides for additional support.

The second holder 168 includes a second projection 290 operably configured to project downwardly when in use, in a direction opposite to the first projection 250 and operably configured to bear against a portion of a top edge 169 of the second architectural finish element 170. In particular, in this embodiment, the second projection 290 is configured to bear against the second flat top surface 146 and a vertical surface 292 between the first and second flat top surfaces 144 and 146 of the second architectural finish element 170 such that the top edge 169 of the second architectural finish element is aligned with the bottom edge 167 of the architectural finish element 140 held by the first receptacle 252 and first projection 250.

When architectural finish elements 140 and 170 of the type described are secured to the architectural structure in the above manner, adjacent tenons 158 and the planar surface portions 274 between adjacent tenons form air passageways 300 that extend parallel to the tenons and permit air to move therein, in a direction generally parallel to the orientation of the tenons. This enables moisture that may ingress between adjacent architectural finish elements 140 and 170 to reach an air passageway 300. Such air passageways 300 formed by respective vertically adjacent architectural finish elements 140 and 170 are in communication with each other and facilitate airflow vertically along the passageways, which facilitates drying of moisture therein, thereby impeding moisture from reaching the architectural structure to which the architectural finish elements are attached. Thus, the tenons 158 act as integral moisture path interference structures operably configured to interfere with seepage of moisture from between adjacent architectural finish elements toward the architectural structure.

Referring to FIGS. 9 and 10, in the event of any movement of the architectural finish elements 140 and 170 relative to the surface of the architectural structure to which they are attached, the force absorbing member 184 resiliently deforms in response to such movement between the mounting portion 164 and the surface of the architectural structure and more particularly, absorbs differences in forces between the margins 196 and 198 adjacent the opening 194 in the mounting portion 164 of the dual architectural finish element support apparatus 160 and the surface of the architectural structure. This provides for a non-rigid connection between the architectural finish elements 140 and 170 and the architectural structure to which they are attached and such connection is operable to absorb at least some seismic forces and/or wind loading forces that can be experienced in some areas. Further, the force absorbing member 184 may resiliently deform to accommodate for different thermal expansions or contractions of the architectural finish element 140 and the architectural structure.

A plurality of architectural finish elements as described in connection with FIGS. 6 to 8 and at least one dual architectural finish element support apparatus as described in connection with FIGS. 9 and 10 can be arranged according to an architectural finishing method according to an embodiment of the invention to cooperate to create an architectural finishing system. Generally, the architectural finishing method comprises mounting the mounting portion 164 of the body 162 of at least one dual architectural finish element support 160 to a surface 111 of an architectural structure 11, causing the first holder 166 to hold a portion of the bottom edge 167 of the first architectural finish element 140 in the first holder 166, causing the second holder 168 on the body 162 to hold a portion of the top edge 169 of the second architectural finish element 170 adjacent to the bottom edge 167 of the first architectural finish element 140 and in alignment with the bottom edge of the first architectural finish element such that finish surfaces 172 and 174 of the first and second architectural finish elements 140 and 170 are generally coplanar and the method further involves absorbing mechanical forces between the first and second architectural finish elements and the architectural structure.

The first and second holders 166 and 168 hold the bottom edge 167 of the first architectural finish element 140 and the top edge 169 of the second architectural finish element 170 within about ¼ inches of each other.

Mounting involves causing the flat surface 182 of the body 162 to rest against the surface 111 of the architectural structure 11 and absorbing mechanical forces comprises causing the force absorbing member 184 to be held by the force absorbing member holder 190, in a position to absorb the mechanical loads between the body 162 and the surface 111 of the architectural structure 11.

Causing the force absorbing member 184 to be held comprises causing a portion of the force absorbing member to be held in the opening 194 in the mounting portion 164 and between the guides 204 and 206 on opposite sides of the opening 194.

Causing the force absorbing member 184 to be held also comprises aligning the force absorbing member 184 in the opening 194 and aligning the force absorbing member between the guides 204 and 206 as shown.

Aligning the force absorbing member 184 comprises causing the flat outer surface 218 of the first projection 216 on the force absorbing member 184 to project through the opening 194 and bear against the surface 111 of the architectural structure 11 and causing the first and second end portions 222 and 224 of the holding portion 220 of the force absorbing member 184 to overlap with corresponding margins 196 and 198 on opposite sides of the opening 194 when the first projection 216 is received in the opening 194.

Absorbing forces comprises causing the fastening bar 186 to receive the fastener 188 through the opening 232 therein and through the force absorbing member 184 such that the fastener bears 188 against the fastening bar 186 to cause the bearing surface 230 of the fastening bar 186 to bear against the holding portion 220 to press the opposite end portions 222 and 224 of the holding portion 220 against the margins 196 and 198 of the mounting portion 164, while holding the projection 216 in contact with the surface 111 of the architectural structure 11, such that differences in forces between the margins 196 and 198 and the surface 111 of the architectural structure 11 are absorbed by the force absorbing member 184.

Absorbing forces also comprises causing the resilient body of the force absorbing member 184 to resiliently deform in response to forces between the surface 111 of the architectural structure 11 and the mounting portion 164.

Causing the first holder 166 on the body 162 to hold a portion of a bottom edge 167 of the first architectural finish element 140 comprises causing the first projection 250 on the first holder 166 to be received in the groove 156 in the bottom edge 167 of the first architectural finish element 140 and holding the bottom edge 167 of the first architectural finish element 140 in a position spaced apart from the surface 111 of the architectural structure 11.

The method further involves causing coplanar distal surfaces 260 and 262 of the guides 204 and 206 to touch the planar surface portion 274 on a back side of the first architectural finish element 140 to position the first architectural finish element on the surface 111.

The method further involves causing the second projection 290 on the body 162 to bear against a portion of the top edge 169 of the second architectural finish element 170.

Although the method described above involves a dual architectural finish element support apparatus 160, in alternative embodiments, architectural finish element such as those illustrated in FIGS. 6 to 11, for example, may be secured to a surface of an architectural structure by placing wet mortar on the surface of the architectural structure and then setting the architectural finish element into the mortar. In such embodiments, the mortar is admitted into dovetailed recesses (such as the air passageways 300 shown in FIG. 11). Such admitted mortar hardens and contacts inward-facing surfaces of the dovetailed recesses, and may thus transmit a securing force to the inward-facing surfaces of the dovetailed recesses to secure the architectural finish element mechanically to the architectural structure. Such mechanical securing (in addition to securing from bonding of the mortar against the rear surface) may advantageously strengthen the securing of the architectural finish element to the architectural structure.

Glued Veneer Elements

Figure 12:
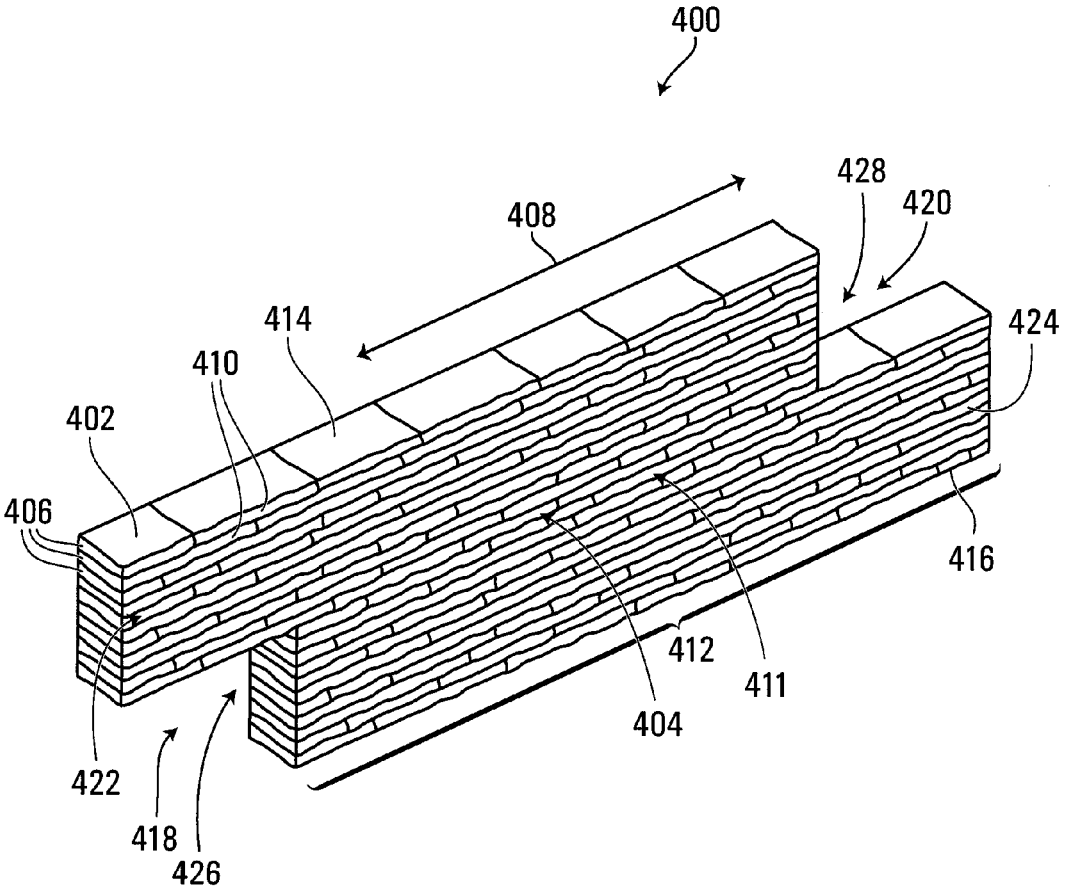
FIG. 12 is a perspective view of an architectural finish element according to a third embodiment of the invention comprising a plurality of glued real stone and veneer elements.

Referring to FIG. 12 an architectural finish element in accordance with another embodiment of the invention, is shown generally at 400. In this embodiment individual unitary real stone elements 402 are lightweight stone elements that are pre-cut and glued together to form a body 404 having the basic form described above such that the overall architectural finish element has a density of more than about 8 pounds per square foot and no more than about 11 pounds per square foot. The unitary real stone veneer elements are glued, such as by epoxy for example, in courses 406 extending in a first direction 408 in a random non-repetitive pattern. The plurality of unitary real stone elements 402 are glued together such that a spacing between adjacent courses is generally between 0 inches to about ¼ inches and such that respective face surfaces 410 of the unitary real stone veneer elements generally lie in a common plane to form an overall face surface 411 of the architectural finish element having a dry-stacked appearance.

Thus, in this embodiment, like the earlier embodiment, the body 404 has main portion 412 and top, bottom and left and right edges 414, 416, 418 and 420. The left and right edges 418 and 420 have complementary shapes for engaging with corresponding right and left edges of left and right adjacent similar architectural finish elements respectively as described above. In the embodiment shown, the left and right edges 418 and 420 of the body 404 have a complementary stepped-shape, wherein the left edge has an upper projection 422 and the right edge has a lower projection 424, both projecting from the main portion 412 by the same distance, to as to form a lower receptacle 426 on the left side of the main portion 412 and an upper receptacle 428 on the right side of the main portion 412. As above, this permits a lower projection of an adjacent left element (not shown) to be received in the lower receptacle 426, while the upper projection 422 of the left edge is received in an upper receptacle (not shown) of the adjacent left element. Similarly an upper projection (not shown) of the adjacent right element (not shown) is received in the upper receptacle 428, while the lower projection 424 of the right edge 420 is received in the lower receptacle (not shown) of the adjacent right element.

Referring to FIG. 3, the top and bottom edges 414 and 416 have top and bottom profiles respectively. The top edge profile extends along the main portion 412 of the body 404 and along a top portion of the upper projection 422 on the left side of the body and along a top portion of the lower projection 424 on the right side of the body. In the embodiment shown, the top and bottom edge profiles are flat planar surfaces such as shown in FIG. 3 that permit the top and bottom edges of adjacent architectural finish elements to be butted up against each with no readily visible joint line.

The courses of the unitary real stone elements 402 are glued together such that upper and lower edges of left side stone elements 402 adjacent the left edge 418 of the body 404 are generally the same distance from the bottom edge 416 of the body as corresponding upper and lower edges of right side veneer elements adjacent the right edge 420 of the body such that when a left edge (not shown) of a first similarly configured adjacent architectural finish element (not shown) is engaged with the right edge 420 of the architectural finish element 400, corresponding courses 406 of real stone veneer elements are aligned to create the appearance of continuous courses of the real stone veneer elements across the architectural finish element 400 and the similarly configured adjacent architectural finish element and such that when a right edge (not shown) of a second similarly configured adjacent architectural finish element (not shown) is engaged with the left edge 418 of the architectural finish element 400, corresponding courses of real stone veneer elements are aligned to create the appearance of continuous courses of the real stone veneer elements across the architectural finish element and the second architectural finish element. In addition, due to the engagement of the stepped left and right edges 418 and 420 and the engagement of the top and bottom edges 414 and 416 with adjacent architectural finish elements, and due to the consistent placement of the real stone elements 402 in courses aligned at each edge, as described above, when a plurality of such architectural finish elements are engaged as described to form an overall surface on the architectural structure, the resulting overall surface has a consistent, uniform dry-stacked appearance with the randomness of stones in respective courses, but with the regularity of courses along the entire finished surface, in a manner similar to that described and shown in connection with FIG. 4.

Figure 13:
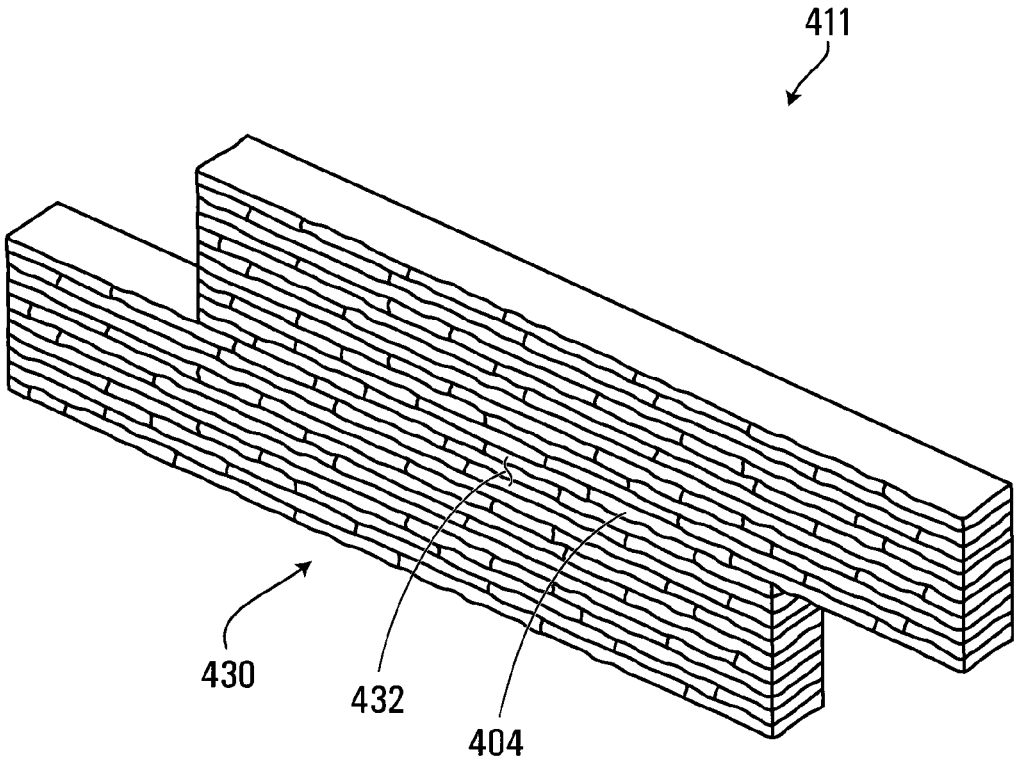
FIG. 13 is a rear perspective view of the architectural finish element shown in FIG. 12.

Referring to FIG. 13, the body 404 has a rear portion 420 disposed opposite the face surface 411. The rear portion 430 faces the architectural structure on which the architectural finish element is to be mounted. In the embodiment shown in FIG. 13, the rear portion 430 has a rear surface 432 opposite the face surface 411 of the body 404 and the rear surface 432 has no dovetailed tenons, but rather has only a generally flat planar portion operable to be directly glued or secured with mortar to the architectural structure.

Figure 14:
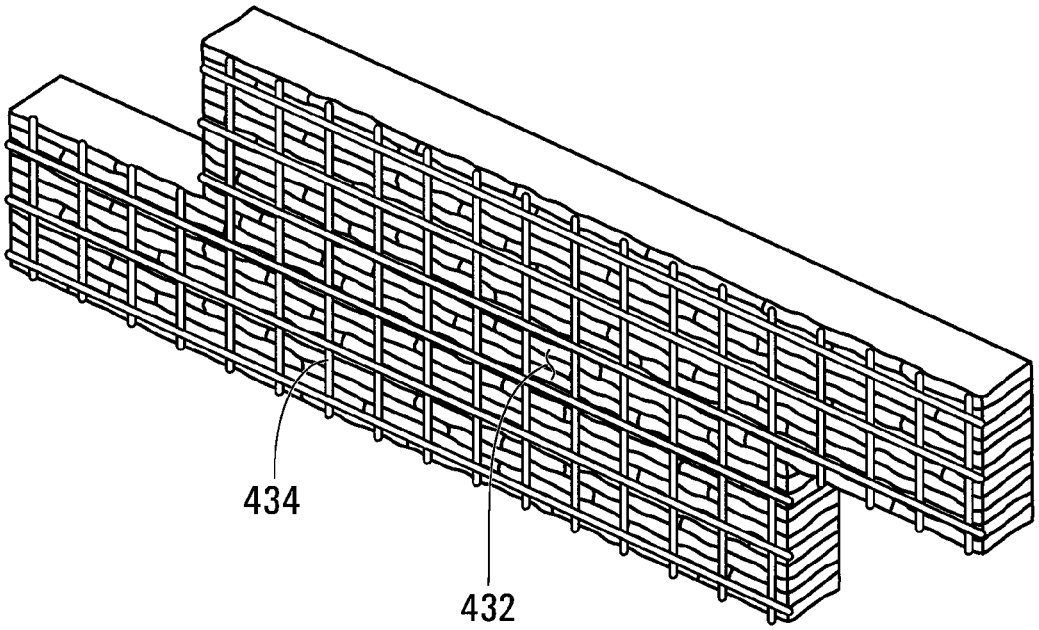
FIG. 14 is a rear view of the architectural finish element of FIG. 12 with a mesh material on the rear surface thereof.

Alternatively, referring to FIG. 14 a mesh material 434 such as wire or plastic mesh, for example, may be glued to the planar rear surface 432.

Figure 15:
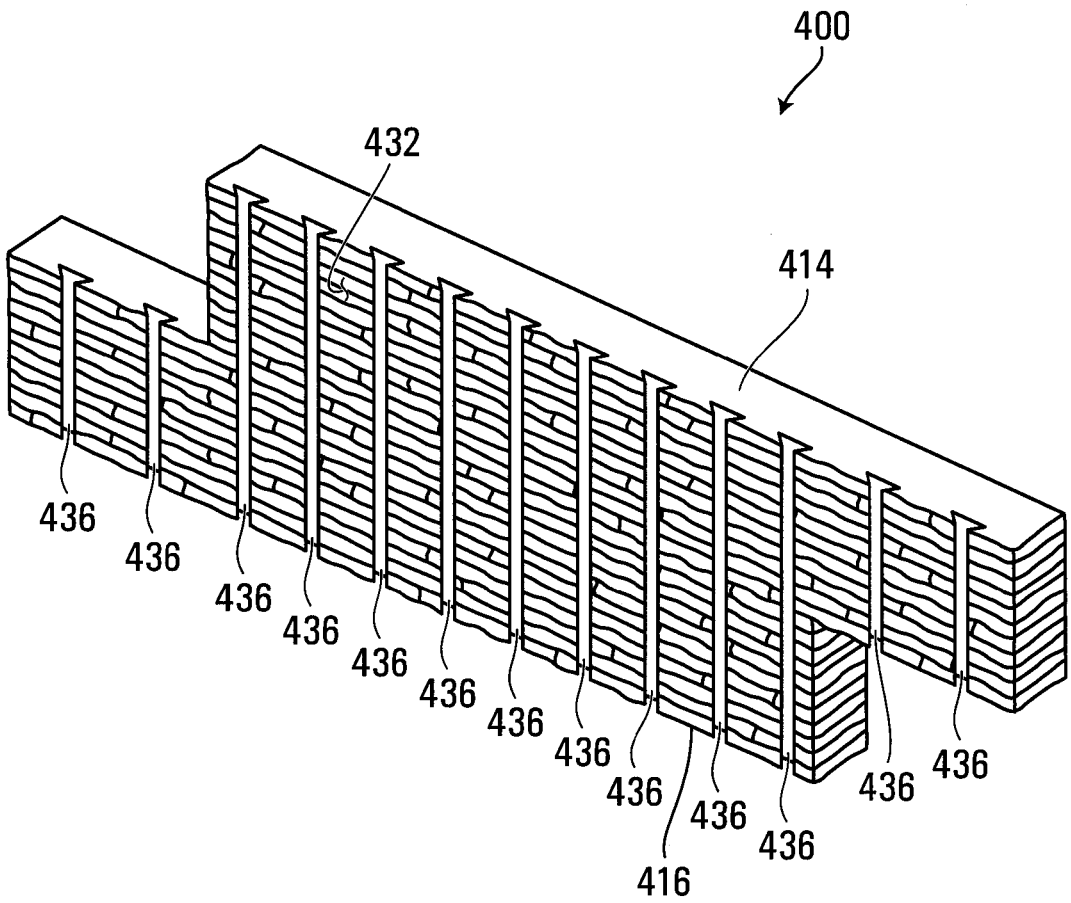
FIG. 15 is a rear view of an alternate rear surface of the architectural finish element of FIG. 12.

As a further alternative, referring to FIG. 15, a plurality of dovetail-shaped recesses 436 may be cut into the rear surface 432 from the top edge 414 to the bottom edge 416 to admit mortar therein. Once hardened, the mortar admitted into the dovetailed recesses 436 of the architectural finish element shown in FIG. 15 contacts inward-facing surfaces of the dovetailed recesses 436, and such admitted mortar may transmit a securing force to the inward-facing surfaces of the dovetailed recesses 436 to secure the architectural finish element mechanically to the architectural structure. Such mechanical securing (in addition to securing from bonding of the mortar against the rear surface 432) may advantageously strengthen the securing of the architectural finish element 400 to the architectural structure.

In any of the embodiments shown in FIGS. 13, 14, and 15, top and bottom edge profiles having single flat surfaces as shown, facilitating abutting adjacent similar surfaces such as described above, may be cut into the body or the body may be formed in a jig to automatically form these flat top surfaces when gluing the individual stone veneer elements together. An architectural finish element so formed would be used like the architectural finish element described in connection with FIGS. 1 to 4, i.e. directly secured to the architectural structure using mortar, without the use of the dual architectural finish support apparatuses of the type described herein. In the embodiment shown in FIG. 13, mortar or glue alone would secure the architectural finish element to the architectural structure. In the embodiment shown in FIG. 14, the mesh material helps secure the architectural finish element to the mortar and in the embodiment shown in FIG. 15, the dovetailed recesses 436 in the rear surface 432 of the architectural finish element admit mortar initially applied to the architectural structure when the architectural finish component is pressed into the mortar.

In alternative embodiments, the top and bottom edges 414 and 416 may have cut therein top and bottom edge profiles as shown in FIGS. 6 and 7, whereupon the architectural finish element so formed can be used with dual architectural finish support apparatuses of the type described herein in connection with FIGS. 9 and 10.

Like the architectural finish elements described in connection with FIGS. 1 to 8 and 11, the architectural finish element formed by gluing individual stone veneer elements together, shown in FIGS. 12 to 15 provides a body 404 with a face surface 411 provided by a collection of real stone elements 402 arranged to have a dry-stacked appearance. An architectural finish element of this type can be made at least large enough, such as in the dimensions described above, to provide about 1.33 square feet of coverage to the architectural structure and can be applied as a unit, avoiding individual placement of real stone veneer element directly on the architectural structure. Again, this enables rapid application of a finishing surface or outer cladding to an architectural structure 1.33 square feet at a time, rather than direct application of real stone veneer elements that cover only a few square inches at a time, while still achieving a dry-stacked appearance.

While specific embodiments of the invention have been described and illustrated, such embodiments should be considered illustrative of the invention only and not as limiting the invention as construed in accordance with the accompanying claims.

The embodiments of the invention in which an exclusive property of privilege is claimed are defined as follows:

1. An architectural finishing system comprising:

first and second architectural finish elements;

at least one dual architectural finish element support system comprising:

a support body including:

a mounting portion facilitating mounting the support body to a surface of an architectural structure;

a first holder operably configured to hold a portion of a bottom edge of said first architectural finish element; and a second holder operably configured to hold a portion of a top edge of said second architectural finish element adjacent to said bottom edge of said first architectural finish element and in alignment with said bottom edge of said first architectural finish element such that finish surfaces of said first and second architectural finish elements are generally coplanar; and a load absorber operably configured to absorb mechanical forces between said mounting portion and said architectural structure;

wherein said mounting portion comprises a sheet portion having a flat surface for resting against said surface of said architectural structure;

wherein said load absorber comprises a force absorbing member and wherein said sheet portion has a force absorbing member holder for holding said force absorbing member in a position to absorb said mechanical forces between said mounting portion and said surface of said architectural structure; and wherein said force absorbing member holder comprises a wall defining an opening in said sheet portion and guides extending from said wall and disposed adjacent said opening for holding a portion of said force absorbing member in said opening and between said guides.

2. The architectural finishing system of claim 1, wherein the first architectural finish element is operable to be placed adjacent similar architectural finish elements to form a finished surface on the architectural structure, the first architectural finish element comprising:

a finish element body formed of a rock-based composite material comprising about 25% to about 50% by volume of a low density solid particle additive; and a plurality of unitary real stone veneer elements bonded to said finish element body in courses extending in a first direction and in a random non-repetitive pattern, said real stone veneer elements having respective face surfaces generally lying in a plane to form the finish surface of said first architectural finish element.

3. The architectural finishing system of claim 2 wherein said low density solid particle additive is at least one selected from the group consisting of a polymer particle, recycled waste, non-toxic waste, post manufacturing waste, and post consumer waste.

4. The architectural finishing system of claim 2 wherein said rock-based composite material comprises pumice and cement.

5. The architectural finishing system of claim 2 wherein said finish element body has top, bottom, left, and right edges and wherein said left and right edges have complementary shapes for engaging with corresponding right and left edges of left and right adjacent similar architectural finish elements respectively.

6. The architectural finishing system of claim 5 wherein said left and right edges of said finish element body have a complementary stepped-shape.

7. The architectural finishing system of claim 2 wherein said plurality of unitary real stone veneer elements are bonded to said finish element body such that a spacing between adjacent courses is generally between 0 inches to about ¼ inches to cause said real stone veneer elements forming said overall face surface to have a dry-stacked appearance.

8. The architectural finishing system of claim 2 wherein said finish element body has top, bottom, left, and right edges and wherein said courses of said unitary real stone veneer elements are bonded to said finish element body such that upper and lower edges of left side veneer elements adjacent said left edge of said finish element body are generally the same distance from said bottom edge of said finish element body as corresponding upper and lower edges of right side veneer elements adjacent said right edge of said finish element body such that when a left edge of a first similarly configured adjacent architectural finish element is engaged with said right edge of said architectural finish element, corresponding courses of real stone veneer elements are aligned to create the appearance of continuous courses of said real stone veneer elements across said architectural finish element and said similarly configured adjacent architectural finish element and such that when a right edge of a second similarly configured adjacent architectural finish element is engaged with said left edge of said architectural finish element corresponding courses of real stone veneer elements are aligned to create the appearance of continuous courses of said real stone veneer elements across said architectural finish element and said second architectural finish element.

9. The architectural finishing system of claim 8 wherein said top and bottom edges have top and bottom profiles respectively for cooperating with support apparatus to secure said architectural finish element to said architectural structure.

10. The architectural finishing system of claim 9 wherein said finish element body has a rear portion disposed opposite said face surface and wherein said rear portion includes an integral moisture path interference structure operably configured to interfere with seepage of moisture from between adjacent said architectural finish elements toward said architectural structure.

11. The architectural finishing system of claim 10 wherein said moisture path interference structure includes a rear surface opposite said face surface, on said finish element body, said rear surface comprising generally planar portions and a plurality of parallel spaced apart spacers extending between said top and bottom edges of said finish element body.

12. The architectural finishing system of claim 11 wherein said spacers comprise dovetailed tenons.

13. The architectural finishing system of claim 12 wherein at least some of said dovetailed tenons have a recess to receive a portion of a mounting element.

14. The architectural finishing system of claim 13 wherein at least some of said dovetailed tenons are spaced apart between said top and bottom edges to form air passageways that permit air to move in a direction generally parallel to the direction of said courses of said real stone veneer.

15. The system of claim 2 wherein said rock-based composite material has a compressive strength of at least about 2000 pounds per square inch when fully cured.

16. The system of claim 2 wherein said rock-based composite material further comprises cement mixed with an aggregate comprised of pumice.

17. The system of claim 16 wherein said cement is mixed with said aggregate in a ratio of 1.5:2.

18. The system of claim 1, wherein:

the first architectural finish element comprises a finish element body comprising said bottom edge, wherein said body of said first architectural finish element is formed of a rock-based composite material comprising about 25% to about 50% by volume of a low density solid particle additive.

19. The system of claim 18 wherein said first architectural finish element further comprises a plurality of unitary real stone veneer elements bonded to said body of said first architectural finish element, each of said plurality of unitary real stone veneer elements having respective face surfaces generally lying in a plane to form the finish surface of said first architectural finish element.

20. The system of claim 18 wherein said low density solid particle additive is at least one selected from the group consisting of a polymer particle, recycled waste, non-toxic waste, post manufacturing waste, and post consumer waste.

21. The system of claim 18 wherein said rock-based composite material has a compressive strength of at least about 2000 pounds per square inch when fully cured.

22. The system of claim 18 wherein said rock-based composite material further comprises cement mixed with an aggregate comprised of pumice.

23. The system of claim 22 wherein said cement is mixed with said aggregate in a ratio of 1.5:2.

24. The system of claim 18 wherein said first holder holds substantially all of a weight of said first architectural finish element.

25. The system of claim 24 wherein said first holder contacts only said bottom edge of said first architectural finish element.

26. The system of claim 24 wherein said first holder includes a first projection received in a groove in said bottom edge of the first architectural finish element and defined by said rock-based composite material.

27. The system of claim 24 further comprising a second at least one architectural finish element support comprising a body including:

a mounting portion facilitating mounting the body of said second at least one architectural finish element support to said surface of said architectural structure; and a holder operably configured to hold a portion of a top edge of said first architectural finish element.

28. The system of claim 27 wherein said first architectural finish element is supported on said architectural structure only at said portion of said bottom edge and at said portion of said top edge.

29. The system of claim 18 wherein said first holder includes a first projection operably configured to be received in a groove in said bottom edge of the first architectural finish element and defined by said rock-based composite material.

30. The system of claim 18 wherein said first holder includes a first receptacle spaced apart from said mounting portion, for holding said bottom edge of the first architectural finish element in a position spaced apart from said surface of the architectural structure.

31. The system of claim 18 wherein said at least one architectural finish element support further comprises a second holder operably configured to bear against a portion of a top edge of a second architectural finish element.

32. The system of claim 18 wherein said first and second holders position a joint between a bottom edge of said finish surface of said first architectural finish element and a top edge of said finish surface of said second architectural finish element below said first and second holders.

33. The system of claim 18 wherein said first at least one architectural finish element support defines at least one surface that touches a cooperating surface on a back side of the first architectural finish element to separate the back side of the first architectural finish element from the architectural structure.

34. The system of claim 1 wherein said first and second holders hold said bottom edge of said first architectural finish element and said top edge of said second architectural finish element within about ¼ inches of each other.

35. The system of claim 1 wherein said force absorbing member comprises a first aligner operably configured to align said force absorbing member in said opening and a second aligner operably configured to align said force absorbing member against said guides.

36. The system of claim 35 wherein said first aligner comprises a projection on said force absorbing member, said projection having a flat outer surface for bearing against said surface of said architectural structure and having a shape complementary to a shape of said opening and wherein said second aligner comprises a holding portion on said force absorbing member adjacent said projection and having first and second opposite end portions extending outwardly on opposite sides of said projection such that said first and second opposite ends overlap with corresponding margins of said sheet portion on opposite sides of said opening when said projection is received in said opening.

37. The system of claim 36 wherein said load absorber further comprises a fastening bar having a bearing surface having a shape corresponding to a shape of said holding portion of said force absorbing portion, and said fastening bar having an opening for receiving a fastener operable to extend through said fastening bar and through said force absorbing member such that said fastener bears against said fastening bar to cause said bearing surface of said fastening bar to bear against said holding portion to press said opposite ends of said holding portion against said margins of said sheet portion, while holding said projection in contact with said surface of said architectural structure, such that differences in forces between said sheet portions and said surface of said architectural structure are absorbed by said force absorbing member.

38. The system of claim 37 wherein said force absorbing member comprises a resilient body resiliently deformable in response to forces between said surface of said architectural structure and said mounting portion.

39. The system of claim 38 wherein said resilient body is comprised of Neoprene.

40. The system of claim 1 wherein said body of said architectural finish element support system is formed of a unitary piece of sheet metal bent into a form defining said mounting portion, said first holder and said second holder.

41. The system of claim 40 wherein said first holder includes a first projection operably configured to be received in a groove in said bottom edge of said first architectural finish element.

42. The system of claim 41 wherein said first holder includes a first receptacle spaced apart from said mounting portion, for holding said bottom edge of said first architectural finish element in a position spaced apart from said surface of said architectural structure.

43. The system of claim 42 wherein said first receptacle is defined by a first set of bent portions of said unitary piece of sheet metal.

44. The system of claim 43 wherein said guides have generally coplanar distal edges lying in a plane spaced apart from said first projection by a distance enabling said coplanar distal edges to touch a cooperating surface on a back side of said architectural finish element.

45. The system of claim 43 wherein said second holder includes a second projection operably configured to bear against a portion of a top edge of said second architectural finish element.

* * * * *